US010399646B2

(12) United States Patent
Roodenburg et al.

(10) Patent No.: US 10,399,646 B2
(45) Date of Patent: Sep. 3, 2019

(54) OFFSHORE DRILLING VESSEL

(71) Applicant: ITREC B.V., Schiedam (NL)

(72) Inventors: Joop Roodenburg, Schiedam (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 218 days.

(21) Appl. No.: 15/520,964

(22) PCT Filed: Oct. 23, 2015

(86) PCT No.: PCT/NL2015/050737

§ 371 (c)(1),
(2) Date: Apr. 21, 2017

(87) PCT Pub. No.: WO2016/085329

PCT Pub. Date: Jun. 2, 2016

(65) Prior Publication Data

US 2017/0341716 A1 Nov. 30, 2017

(30) Foreign Application Priority Data

Oct. 23, 2014 (NL) ..... 2013675

(51) Int. Cl.
*B63B 35/03* (2006.01)
*B63B 35/44* (2006.01)
(Continued)

(52) U.S. Cl.
CPC ..... *B63B 35/03* (2013.01); *B63B 35/4413* (2013.01); *E21B 15/02* (2013.01);
(Continued)

(58) Field of Classification Search
CPC ..... B63B 35/03; B63B 35/4413; E21B 15/02; E21B 33/064; E21B 3/045; E21B 19/002
(Continued)

(56) References Cited

U.S. PATENT DOCUMENTS 3,368,509 A 2/1968 Knight, Jr. et al.
3,498,375 A 3/1970 McEwen et al.
(Continued)

FOREIGN PATENT DOCUMENTS

EP 2 186 993 A1 6/2010
WO WO 97/18987 A1 6/1997
(Continued)

*Primary Examiner* — Anna M Momper
*Assistant Examiner* — Patrick F Lambe
(74) *Attorney, Agent, or Firm* — Birch, Stewart, Kolasch & Birch, LLP

(57) ABSTRACT

The invention relates to a vessel comprising a moonpool, a firing line hoist system, a stationary main deck for storing equipment and/or tubulars, and a mobile working deck having a front deck section and a rear deck section. The working deck can be moved between a working position and a transporting position. A rear deck lift system is provided for lifting and lowering a rear deck section between the working position and the transporting position. A front deck guide system is provided for guiding a front deck section in a substantially horizontal direction between the working position and the transporting position.

20 Claims, 12 Drawing Sheets

(51) Int. Cl.

| | |
|---|---|
| ***E21B 15/02*** | (2006.01) |
| ***E21B 33/064*** | (2006.01) |
| *E21B 3/04* | (2006.01) |
| *E21B 19/00* | (2006.01) |

(52) U.S. Cl.
CPC ..... *E21B 33/064* (2013.01); *E21B 3/045* (2013.01); *E21B 19/002* (2013.01)

(58) Field of Classification Search
USPC ..... 175/5
See application file for complete search history.

(56) References Cited

U.S. PATENT DOCUMENTS

| | | | | |
|---|---|---|---|---|
| 4,230,190 | A | 10/1980 | Guinn et al. | |
| 2009/0151955 | A1* | 6/2009 | Bamford | E21B 3/045 166/335 |

FOREIGN PATENT DOCUMENTS

| | | | |
|---|---|---|---|
| WO | WO 2008/121071 | A1 | 10/2008 |
| WO | WO 2009/102197 | A2 | 8/2009 |
| WO | WO 2012/168428 | A1 | 12/2012 |
| WO | WO 2013/169099 | A2 | 11/2013 |
| WO | WO 2015/133892 | A1 | 9/2015 |

* cited by examiner

OFFSHORE DRILLING VESSEL

FIELD OF THE INVENTION

The present invention relates to a vessel, in particular a vessel comprising a moonpool, for example a vessel for oil and gas exploration, well servicing, etc.

BACKGROUND OF THE INVENTION

It is known to provide vessels having a moonpool and a hoisting device adjacent the moonpool with a mobile working deck, i.e. a working deck that in working position covers the moonpool and allows workmen to approach the firing line passing through the working deck and the moonpool, and in another position is removed from the moonpool to enable the transport of equipment through the moonpool.

Typically, a mobile working deck is a single part, removable working deck. These working decks can be moved, for example using a hoisting device, between a storage position and a working position. Typically, the storage position is located some distance away from the moonpool, such that transport of the working deck takes a significant amount of time. When the working deck is stored close to the moonpool it often obstructs access to the moonpool when in the storage position.

It is furthermore known to provide a pivotable working deck, which working deck is pivoted between a working position in which it covers the moonpool and an upright storage position in which it is located adjacent the moonpool. Although the pivoted position allows for moving equipment into the moonpool, the pivotable deck also forms an obstruction and thus allows for limited transport only.

In WO2009/102197, which is incorporated herein by reference, a vessel comprising a moonpool is disclosed. The monohull drilling vessel is furthermore provided with firing line hoist systems mounted on the hull. The firing line hoist systems comprises:

- a tower, which tower has a top side and a base, a first side and a second side, and wherein the base of the tower is connected to the hull of the drilling vessel at opposite sides of a moonpool, such that the first side of the tower and the second side of the tower bridge the moonpool in a lateral direction thereof, and
- a hoisting device, which hoisting device comprises a load attachment device displaceable supported by the tower, one or more cables and one or more associated winches to manipulate the position of the load attachment device relative to the tower in a vertical direction along a firing line, which firing line extends on the outside of and adjacent to the first side of the tower and through the moonpool, and which hoisting device is adapted for raising and lowering a BOP (Blow Out Preventer) to the seabed;

The vessel is furthermore provided with:

- a BOP transport system, configured for moving a BOP between a storage position and a launch position, in which launch position the BOP is located in the firing line adjacent the first side of the tower, and in which launch position the BOP can be manipulated by the hoisting device, wherein the BOP transport system comprises a BOP track with two parallel guide rails and a BOP transport cart which is movably supported by those guide rails; and
- a mobile working deck that is provided at the first side of the tower, and which working deck in an active position extends in a substantially horizontal direction and covers a portion of the moonpool, while the firing line extends through the working deck, and in a non-active position provides room for a BOP to be moved by the BOP transport system into a launch position above the moonpool.

By arranging the mobile working deck in a mobile manner the deck can be in a relative low position with respect to the waterline when work has to be carried out on the working deck, e.g. assembly of a riser string or a drill string. The mobile working deck is removed when a BOP is to be positioned in the firing line. After the BOP has been positioned in the firing line, and has been lowered, the mobile working deck is returned into its active position.

In case the mobile working deck is a sliding working deck, the mobile working deck is supported by the BOP track such that it can be slid along the BOP track in a direction perpendicular to a longitudinal axis of the moonpool between a first position in which the working deck covers a portion of the moonpool and the firing line extends through the working deck, and a second position adjacent the moonpool, in which the working deck provides room for a BOP to be moved by the BOP transport system into a launch position above the moonpool. After the BOP is brought into the firing line it is lowered onto a cart positioned above the moonpool. The mobile deck is replaced and the BOP is lifted and suspended from a suspension device of the working deck. Subsequently a riser section is connected to the top end of the BOP, and the BOP and riser section are lowered by means of hoisting device into the sea. This is an elaborate process.

The configuration with a deck that is slideable supported by the BOP track, allows for one BOP to be stored at one side of the moonpool and the working deck to be parked on the opposite side of the moonpool.

In an alternative embodiment, the mobile working deck is configured to be lifted by the firing line hoist system, such that the BOP can be brought underneath the mobile working deck. The tower is preferably provided with a deck holding device at an elevated position along the tower to hold the deck in the raised, non-active position. It is noted that the working deck is configured for supporting substantially heavy loads, and therefore is quite heavy itself. The deck holding device and the tower should therefore be dimensioned to support the heavy working deck at a substantial height above the main deck. It is furthermore noted that the mobile deck is arranged pivotally, so that e.g. it can be brought in a vertical non-active position. For instance the mobile deck may have two pivotable deck parts.

Currently there is the need to transport multiple subsea devices, such as BOPs and subsea trees. The known drilling vessels provide at most two BOP parking positions, in which case the working deck is to be lifted by the firing line hoisting system to allow a BOP to be moved in the firing line, the lifting of the working deck limits the use of the firing line hoisting system.

OBJECT OF THE INVENTION

It is an object of a first aspect of the invention to provide a vessel with a working deck in which the above mentioned drawbacks are eliminated altogether or occur in a greatly reduced extent.

In particular it is an object of the first aspect of the invention to provide an improved mobile working deck.

According to a second aspect of the present invention it is an object to provide an offshore drilling vessel able to transport multiple subsea devices, such as BOPs and subsea trees, preferably stored in a manner which makes them easily available for manipulation by the firing line hoist system of the drilling vessel.

SUMMARY OF THE INVENTION

According to the first object, the according to a first aspect, the present invention provides a vessel, the vessel comprising:

- a hull having a moonpool;
- a firing line hoist system, the firing line hoist system comprising
  - a tower, which tower is arranged at said moonpool, and is connected to the hull of the vessel, and
  - a hoisting device, which hoisting device comprises a load attachment device, one or more cables and one or more associated winches to manipulate the position of the load attachment device relative to the tower in a vertical direction along a firing line, which firing line extends through the moonpool, wherein the hoisting device is adapted for raising and lowering equipment through the moonpool;
- a stationary main deck for storing equipment and/or tubulars;
- a mobile working deck, which working deck is configured to be moved between a working position and a transporting position, the mobile working deck comprising a front deck section having a deck opening for receiving the firing line, and a rear deck section located adjacent the stationary main deck;
- a rear deck lift system for lifting and lowering the rear deck section, independent of the front deck section, between the working position and the transporting position, and
- a front deck guide system for guiding the front deck section, independent of the rear deck section, in a substantially horizontal direction between the working position and the transporting position, wherein, when the working deck is in the working position, the front deck section and the rear deck section are located adjacent each other, with the working deck front section located above the moonpool and adjacent the tower such that the firing line extends through the deck opening of the working deck, and wherein, when the working deck is in the transporting position, the front deck section is located above the rear deck section and adjacent the stationary main deck.

The invention thus provides a two-part mobile working deck. According to a first aspect of the invention, the two part mobile working deck in combination with the rear deck lift system and the front deck guide system allow for a compact configuration of the working deck when in the transporting position. Thus, the working deck, in particular the working deck front section, can be located adjacent the moonpool when in the transporting position. According to the first aspect the invention thus provides an improved mobile working deck. Since the working deck does not obstruct access to the moonpool when in the transporting position, it allows for efficient transport of equipment from the main deck to the moonpool and vice versa.

In an embodiment of a vessel according to the first aspect of the invention, the main deck is flush with the working deck rear section when the working deck is in the working position, such that objects can be moved in a horizontal direction from the main deck onto the working deck, and the working deck front section is flush with the main deck when the working deck is in the transport position, such that objects can be moved in a horizontal direction from the main deck onto the working deck front section.

The working deck thus allows for equipment to be moved directly from the main deck onto the working deck rear section, when the working deck is in the working position, and directly from the main deck onto the working deck front section, when the working deck is in the transporting position. This is especially beneficial with heavy equipment, since it can be moved from the main deck onto the working deck without negotiating a height difference. The mobile working deck thus allows for efficient transport of equipment from the main deck to the moonpool and vice versa.

Thus, a vessel according to the invention comprises a working deck having a working deck front section and a working deck rear section, which working deck front section is a slideable deck section, configured to be slid onto the rear section of the working deck to convert the working deck into transporting position, i.e. a position in which the moon pool is open at least near the firing line for passing equipment, for example BOP's or subsea trees, through the moon pool using the hoisting device.

Furthermore, the embodiments according to the invention described above, allow the working deck front section to be used as a transport device, for transporting equipment in the firing line.

In an embodiment of a vessel according to the first aspect of the invention, the main deck is provided with transport rails for supporting carts to transport objects over the main deck, and wherein the working deck front section is provided with transport rails, which, when the working deck is in the transporting position, are in line with transport rails provided on the main deck such that a cart can be driven over the transport rails from the main deck onto the working deck and vice versa.

This further facilitates transporting equipment from the main deck onto the working deck and into the firing line.

In an embodiment, the rails are provided on top of the deck surfaces. In an alternative embodiment, the rails are partially or fully recessed in the working deck front section and/or main deck.

In an embodiment, the working deck front section, when in the transporting position, is provided with an insert that covers the deck opening, or part thereof, which insert is preferably provided with a rail section, to facilitate moving equipment from one end of the deck opening to the other end of the deck opening.

In an embodiment, the vessel is provided with multiple storage positions for subsea devices, in particular BOPs and subsea trees, which are located adjacent the working deck front section when located in the transporting position. As will be explained in more detail below, the mobile working deck according to the invention also allows for providing BOP storage positions on opposite sides of the working deck front section, when located in the working position. In such an embodiment, the vessel may be provided with a BOP transport system for moving the BOP into and out of the firing line.

Furthermore, in such an embodiment, subsea tree storage positions can be located on the main deck on opposite sides of the working deck front section, when in the transporting position. Preferably the main deck deck surface and the working deck deck surface, in particular the working deck front section deck surface, are substantially level, or at least are provided with transport rails which are level, to enable the subsea trees to be moved in a substantially horizontal direction between the subsea tree storage position on the working deck and a transport position on the working deck front section.

Thus, the subsea trees as well as the BOPs can be moved efficiently between their storage position and their launching position in the firing line.

The invention also provides a method for moving equipment into the firing line, using the working deck front section of a working deck according to the invention as a transport device.

The method comprises:

- lowering the working deck rear section, independent of the working deck front deck section, from the working position into the transporting position, using the a rear deck lift system;
- moving the working deck front section, independent of the working deck rear section, from the working position into the transporting position, in which the working deck front section is located adjacent the main deck, using the front deck guide system
- moving equipment form the main deck onto the working deck front section;
- moving the working deck front section and the equipment located thereon, independent of the working deck rear section, from the transporting position into the working position, in which the working deck front section is located adjacent the tower and the equipment located on the working deck front section is thus located in the firing line.

In a further method according to the invention subsequently;

- the equipment is attached to the hoisting device using the load attachment device,
- the equipment is lifted by the hoisting device;
- the working deck front section is again moved into the working position; and
- the equipment is lowered, by the hoisting device into the sea via the moonpool.

It is submitted that the working deck according to the invention can also be used for removing equipment out of the firing line.

Thus the invention does not only provide a compact mobile working deck, it furthermore enables the mobile working deck to be utilized as transport device for positioning objects, for example equipment such a small BOP or a subsea tree, into the firing line, and for removing equipment out of the firing line. The working deck front section guide system is thus not only used for moving the working deck front section but also for moving objects supported by the working deck front section into, and out of, the firing line, which allows for an efficient use of equipment.

In an embodiment of a vessel according to the first aspect of the invention, the front deck guide system comprises:

- two support rails for supporting the working deck front section when the working deck front section is in the transporting position and while the working deck front section is being moved between the working position and the transporting position, and
- wherein the rear deck section is located above the two support rails when in the working position and is located between and/or below the two support rails when in the transporting position.

Thus the working deck rear section does not need to support the weight of the working deck front section and possibly of equipment located on the working deck front section. Therefore, only the working deck front section, and the support rails, need to be configured for supporting large loads. The working deck rear section can be kept light and nimble, which in turn allows for using a simple working deck rear section lifting system.

In a preferred embodiment, the two support rails are supported by the hull of the vessel. In an embodiment, the support rails are supported by support beams which cross a moonpool extending below the working deck rear section.

In an alternative embodiment, the working deck front section is supported by the working deck rear section when the working deck front section is in the transporting position and while the working deck front section is being moved between the working position and the transporting position. In such an embodiment, the working deck rear section is for example provided with one or more guide surfaces, or for example with support rails, for supporting the working deck front section.

In a further embodiment of a vessel according to the first aspect of the invention, a coupling device is provided that can coupled the rear deck section with the support rails when the rear deck section is in the working position, such that the weight of the rear deck section, and any equipment located on the rear deck section, is supported by the two support rails and not by the rear deck lift system. Thus, the support structure used for supporting the working deck front section, when in the transporting position, is also utilized for supporting the working deck rear section, when in the working position.

In a further embodiment of a vessel according to the first aspect of the invention, the rear deck section has a central deck section flanked by two movable side sections, for example hingeable deck sections, which movable side sections can be moved, for example pivoted, between an extended position, in which they cover the support rails when the rear deck section is in the working position, and a withdrawn position, in which they are located between the support rails when the rear deck section is in transporting position.

This allows for a compact configuration, more in particular a limited height, of the working deck when in the transporting configuration in combination with a heavy duty working deck front section, i.e. a working deck configured to support great loads with the working deck front section, when the working deck front section is in the working position and when the working deck front section is in the transporting position. This configuration is especially beneficial when the working deck front section is used for transporting equipment.

In a further embodiment of a vessel according to the first aspect of the invention, the support rails for supporting the working deck front section extend over the moon pool, such that they also support the working deck front section when in the working position, or are extendable support rails, which when extend cross the moon pool for supporting the working deck front section when being moved into or out of the working position. In an embodiment, these support rails can be retracted when the working deck front section is in the transporting position, to provide an extra wide opening and thus enable the hoisting device to lower extra wide objects through the opening into and out of the moon pool.

It is noted that in a preferred embodiment the working deck rear section, when in the working position, has deck surface substantially similar to the deck surface of the working deck front section, such that the deck surface of the working deck front section fits the opening created by lowering the working deck rear section in the transporting position.

In an embodiment, the vessel comprises a BOP transport track for moving BOP's between a storage position and a launch position, in which the BOP is located in the firing line.

In an embodiment, the BOP transport track comprises rails in the form of beams that cross the moon pool, and that are supported by the hull on opposite sides of the moon pool. The rails of the BOP track are provided with a guide surface for supporting and guiding a BOP cart. In an embodiment, the working deck front section crosses the BOP transport track when in the working position. In a further embodiment, the working deck front section is supported by at least one of the rails, either in direct contact with the guide surface of the rails or with a dedicated working deck front section support surface of the support rails. In addition or as an alternative, the BOP cart or carts is or are respectively provided with a dedicated working deck front section support surface for guiding the working deck front section when in the working position and/or for supporting the working deck front section while being moved between the working position and the transporting position.

In an embodiment of a vessel according to the first aspect of the invention, the front deck guide system comprises two extendable support arms, preferably telescopic support arms, which support arms, when extended, cross the moon pool to support the front deck section when moved between the working position and the transporting position and/or when in the working position.

In a further embodiment of a vessel according to the first aspect of the invention, the extendable support arms comprise hydraulic cylinders configured to push or pull the front working deck section into or out of the transporting position.

In a further embodiment of a vessel according to the first aspect of the invention, the extendable support arms have an upward facing guide surface for cooperating with a downward facing guide surface provided on the front deck section. Thus, the support arms form a guide track. The guide surfaces preferably have a slanted front and/or end section such the front deck section is slightly lifted when the guide surfaces of the guide arms meet the guide surfaces of the front deck section while the support arms are extended into their support position.

In an alternative embodiment, the front deck guide system comprises two support arms, which support arms are fixed to the working deck front section on opposite sides of the deck opening, and which fixed arms extend beyond the deck surface area of the working deck front section, and extend below the working deck rear section, when both are in the working position. The fixed support arms are moveably secured, such that they support the working deck front section when moved between the working position and the Transporting position. In an alternative embodiment, the front deck guide system comprises support tracks supported by the hoisting device, preferably located on a trolley of the hoisting device, for supporting the front deck section while being moved between the working and Transporting position.

In an embodiment of a vessel according to the first aspect of the invention, the working deck front section comprises a support frame with at least two load bearing support beams, which support beams extend on opposite sides of the deck opening, In a further embodiment, these support beams function also as a skid frame and have a guide surface for cooperation with guides surfaces provided on support beams, BOP carts, the working deck rear section, etc. for guiding and/or supporting the working deck front section when being moved between the working position and the transporting position and/or when in the working position and/or the transporting position.

In a further embodiment of a vessel according to the first aspect of the invention, the working deck front section comprises a suspension device, preferably a suspension device for supporting objects, for example a tubular, in the firing line. The suspension device is preferably attached to and supported by the support beams, such that a load supported by the suspension device is transferred directly from the suspension device to the support In a further embodiment, the working deck front section is thus configured to, when in its working position, support the weight of a suspended string of tubulars in combination with a BOP and/or subsea tree.

In an embodiment of a vessel according to the first aspect of the invention, the working deck front section is U-shaped, comprising two legs extending on opposite sides of the deck opening, which deck opening is part of a slot shaped opening, the slot shaped opening extending up to a frontal edge of the working deck front section, such that a tubular supported in the firing line can be moved in a lateral direction via said slot into the deck opening by moving the front deck section from the transporting position into the working position. Thus, the working deck front section can be moved into and out of the working position while a tubular is supported in the firing line by the hoisting device. Thus, the working deck is more flexible in use.

In an embodiment of a vessel according to the first aspect of the invention, the working deck and/or the vessel are provided with locking devices for securing the working deck, preferably for securing both the front section and the rear section of the working deck, in the working position and/or in the transporting position, such that the working deck or part thereof, is fixed relative to the hull of the vessel.

In an embodiment of a vessel according to the first aspect of the invention, the working deck rear section lift system is a hydraulic lift, a jackscrew lift, a rack and pinion lift, or a scissors lift.

In an embodiment of a vessel according to the first aspect of the invention, actuators, such as one or more hydraulic cylinders, one or more drives, one or more winches, sprokects combined with chains, rack and pinion drives, etc. are provided for sliding the deck sections of the working deck relative to each other and/or relative to the vessel.

In an embodiment, the vessel has a main deck that is provided with transport rails for supporting carts to transport objects over the main deck, and the working deck front section is provided with transport rails, which, when the working deck is in the transporting position, are in line with transport rails provided on the main deck such that a cart can be driven over the transport rails from the main deck onto the working deck and vice versa.

In an embodiment of a vessel according to the first aspect of the invention the front deck guide system comprises support tracks which can be moved, for example hinged, extended or lifted, between a support position and a storage position, in which support position they at least partially support the working deck front section when moved between the working position and the transporting position.

In a further embodiment, these support tracks extend over a BOP track, which BOP track is provided at the moonpool, while supporting the front section of the deck.

In an embodiment of a vessel according to the invention, a control room is located on the working deck, which control room is fixed to the working deck front section. Thus, the control room moves with the working deck front section when the latter is moved between the working position and the transporting position In an embodiment of a vessel according to the first aspect of the invention, the vessel is an off shore drilling vessel, preferably a monohull drilling vessel, the monohull having an elongate shape extending along a longitudinal axis, wherein the moonpool has an elongate shape extending along a longitudinal axis, the latter being parallel with the longitudinal axis of the monohull drilling vessel. Especially with drilling vessels deck space is limited and a compact working deck thus provides great benefits.

The invention furthermore provides a method for riser string handling and/or BOP installation using an offshore drilling vessel according to the invention.

The invention furthermore provides an offshore drilling vessel comprising:

a hull having a moonpool;

a firing line hoist system, the firing line hoist system being supported by the hull, the firing line hoist system comprising:

a tower, the tower being arranged at said moonpool, and which tower has a top and a base, a first side and a second side, and wherein the base of the tower is connected to the hull of the vessel such that the first side of the tower faces the moonpool, and a hoisting device, which hoisting device comprises a load attachment device displaceable supported by the tower, one or more cables and one or more associated winches to manipulate the position of the load attachment device relative to the tower in a vertical direction along a firing line, which firing line extends on the outside of tower at the first side thereof, and which firing line extends through the moonpool, wherein the hoisting device is adapted for raising and lowering a tubular string with a BOP and/or subsea tree to the seabed;

a BOP transport system, configured for transporting a BOP between a storage position at the BOP storage area and a launch position above the moonpool, in which launch position the BOP is located in the firing line and can be manipulated by the hoisting device, which BOP transport system comprises:

a BOP cart for each BOP storage area; and a BOP track, which BOP track is positioned above the moonpool and comprises two parallel rails, which rails are supported by the hull such that they bridge the moonpool with the firing line passing between the two rails, and which rails support the BOP carts such that the BOP carts can be moved between a storage position for supporting a BOP in its storage position and a firing line position for supporting a BOP in its launch position;

a working deck, located at the first side of the tower, which working deck, when seen in top view, is located between the BOP storage areas, and which working deck has a front section facing the tower and a rear section facing away from the tower, wherein the front section of the working deck is provided with a deck opening for passing a tubular supported in the firing line through the working deck, wherein the working deck is a mobile working deck, configured to be moved between a working position and a BOP transporting position, wherein the front section and the rear section of the working deck are separate deck sections;

and wherein the off shore drilling vessel further comprises:

a rear deck lift system for lifting and lowering the rear deck section, independent of the front deck section, between the working position and transporting position, and a front deck guide system for guiding the front deck, independent of the rear deck section, in a substantially horizontal direction between the working position and transporting position, and wherein, when the working deck is in the working position, the front deck section and the rear deck section are located adjacent each other, with the working deck front section located adjacent the tower such that the firing line extends through the deck opening of the working deck, and the working deck front section covers part of the BOP transport track such that it blocks movement of BOPs along the BOP track, and when the working deck is in the Transporting position, the front deck section is located above the rear deck section, such that the working deck clears the BOP track and provides room for a BOP to be transported by the BOP transport system from the BOP storage position into the BOP launch position above the moonpool.

In such an embodiment, a drilling vessel with an improved mobile working deck according to the invention provides BOP storage areas on opposite sides of the firing line, in combination with a working deck that does not require use of the firing line hoisting system to be moved into a BOP transporting position. The working deck is a mobile working deck, which working deck is partially slid in a direction away from the tower and which is partially lowered when being converted from its working position into its BOP transporting position. When the working deck is in the transporting position, this allows for transporting BOP's along the BOP transport track. Therefore, in the context of this embodiment, the transporting position is also referred to as the BOP transporting position.

In an embodiment according to the invention, the working deck front section is configured to move subsea trees into and out of the firing line, which subsea trees are skidded onto and of the working deck front section when the latter is in the transporting position, i.e. located above the lowered working deck rear section. In this particular embodiment of a vessel and working deck according to the invention, the working deck front section, when in the transporting position, allows for transporting a BOP along the BOP transport track and the working deck front section is able to receive subsea trees. Thus, in this embodiment, the transporting position can be referred to as the BOP transporting position as well as the subsea tree transporting position.

The invention allows for a compact configuration of the working deck and for storage positions provided on opposite sides of the working deck, and thus for storing multiple BOPs and subsea trees such that they can be moved between their storage position and their launch position in the firing line efficiently, i.e. with a minimum of preparation time and/or with a minimum of transfers between transporting devices and/or over a minimum distance, without the working deck or sections thereof blocking the tower and/or the hoisting system.

It will be appreciated that the mobile working deck in such an embodiment is configured to, when in its working position, support the weight of the suspended string of tubulars in combination with a BOP and/or subsea tree. In a practical embodiment said weight will be at least 200 tonnes. Therefore, a working deck according to the invention has a structure able to support a string of tubulars, e.g. risers, possibly with a BOP and/or subsea tree attached to the lower end of the string, having a weight of at least 200 tonnes.

In a further embodiment the vessel furthermore has a stationary main deck for storing equipment and/or tubulars and which main deck is adjacent to and flush with the working deck rear section when the working deck is in the working position, such that objects can be moved in a horizontal direction from the main deck onto the working deck, and the working deck front section is adjacent to and flush with the main deck when the working deck is in the transporting position, such that objects can be moved in a horizontal direction from the main deck onto the working deck front section. In yet a further embodiment, the main deck extends along the tower towards the front of the vessel and at the second side of the tower.

In an embodiment of a drilling vessel according to the first aspect of the invention subsea tree storage positions are provided on opposite sides of the working deck and adjacent the BOP storage positions, and the working deck front section is provided with skid rails/guides for skidding a subsea tree in a horizontal direction from the subsea tree storage position onto the front deck section, when the front deck section is in the BOP transporting position.

In a further embodiment, a subsea tree cart Is provided for each subsea tree storage position, and the main deck is provided with a subsea tree track at each subsea tree storage position, which subsea tree tracks each comprise two parallel rails for supporting an subsea tree cart, which rails extend in a direction perpendicular to the longitudinal axis of the moonpool to enable, when the working deck front section is located in the transporting position, the subsea tree carts to be moved between a storage position for supporting an subsea tree in its storage position and a transporting position located on the working deck front section.

In an embodiment of a drilling vessel according to the first aspect of the invention the front deck guide system comprises support tracks which can be moved, for example hinged, extended or lifted, between a support position and a storage position, in which support position they at least partially support the working deck front section when moved between the working position and the transporting position. In a further embodiment, these support tracks extend over the BOP track.

In a further embodiment of a drilling vessel according to the invention the front deck guide system comprises support tracks located on the BOP carts, at the side of a BOP cart that is facing the firing line, for supporting the front deck section while being moved between the working position and transporting position. Preferably the guide tracks of the BOP carts comprises a guide surface which is level with, and preferably adjacent to, top surfaces of the rails of the BOP transport track, which top surfaces of the rails of the BOP track preferably also guide the BOP carts when moved between the storage and launch position.

In a further embodiment, the BOP carts have a support frame that is provided with a lateral opening that allows for a tubular, for example a riser held by the hoisting device and supporting a BOP, to be moved, in a lateral direction, into or out of the BOP support frame.

In an embodiment of a drilling vessel according to the invention the working deck front section comprises a support frame with at least two load bearing support beams, which support beams extend on opposite sides of the deck opening, which support beams cross the BOP support track, and preferably the support beams rest directly on one of, preferably on both of, the guide rails of the BOP transport track, when the working deck is in its working position.

In a further embodiment of a drilling vessel according to the first aspect of the invention the working deck front section comprises a suspension device, which suspension device is attached to and supported by the support beams, such that a load supported by the suspension device is transferred directly from the suspension device to the support beams.

In a further embodiment of a drilling vessel according to the first aspect of the invention the working deck front section comprises a suspension device, which suspension device enables the working deck front section to suspend a riser string, preferably with a BOP attached to the lower end of the riser string, in the firing line.

In such an embodiment, the front section of the working deck is a heavy duty section, configured for supporting a riser string in the firing line preferably with a BOP and/or a subsea tree attached to the lower end of the riser string, which heavy duty section of the working deck is supported by the rails of the BOP track when the working deck is in its working position. Furthermore, in such an embodiment, the rails of the BOP track are heavy duty rails, configured for together supporting two BOP's of each at least 200 tonnes, and preferably for at the same time supporting the heavy duty section supporting a riser, of the working deck.

In an embodiment of a drilling vessel according to the invention the front deck guide system comprises two extendable support arms, preferably telescopic support arms, which support arms, when extended, cross the BOP guide track. In an embodiment, the extendable support arms are each with one end fixed to one of: the working deck front section, the working deck rear section, the hull of the vessel, the tower. In a further embodiment, the extendable support arms, when retracted, are located fully in or below the working deck front section on opposite sides of the deck opening.

In an embodiment of a drilling vessel according to the first aspect of the invention the extendable support arms are hydraulic cylinders which move and preferably support the working deck front section when it is moved between the working position and the transporting position.

In an alternative embodiment of a drilling vessel according to the first aspect of the invention the extendable support arms have a guide surface and form a guide track for slideable supporting the working deck front section, and which guide surfaces preferably have a slanted front section such the support arms slightly lift the front deck section while being extended into their support position.

In an embodiment, the extendable support arms have one end that can be releasable coupled with the tower or a support of the tower, while the middle section of front deck is moved into the BOP transporting position, and which extendable support arms can be retracted, preferably into the working deck front section, while the working deck front section is located in the transporting position.

In an embodiment the off shore drilling vessel according to the invention further comprises:

- a riser tensioner system adapted to be connected to a top end of a riser string, in order to suspend the riser string from in the second firing line; and/or
- a suspended riser transfer device, comprising:
- a riser hang-off assembly
- a gimbal device; and
- a frame supporting both the riser hang-off assembly and the gimbal device, which frame is moveably supported for movement along the longitudinal axis of the moonpool, preferably is movably supported by the moonpool track.

The invention furthermore provides a method for riser string handling using an offshore drilling vessel according to one or more of the preceding claims. In a method according to the invention a BOP or a subsea tree is lowered from the offshore drilling vessel, the mobile working deck is moved in its BOP transporting position, and the BOP is brought into the first firing line, using the BOP transport system, thus cleared by the mobile working deck.

According to a second aspect, the present invention provides an offshore drilling vessel, the vessel comprising:

a hull having a moonpool, the moonpool having a longitudinal axis;

a firing line hoist system, the firing line hoist system being supported by the hull, the firing line hoist system comprising:

a tower, the tower being arranged at said moonpool, and which tower has a top and a base, a first side and a second side, and wherein the base of the tower is connected to the hull of the vessel such that the first side of the tower faces the moonpool, and a hoisting device, which hoisting device comprises a load attachment device displaceable supported by the tower, one or more cables and one or more associated winches to manipulate the position of the load attachment device relative to the tower in a vertical direction along a firing line, which firing line extends on the outside of tower at the first side thereof, and which firing line extends through the moonpool, wherein the hoisting device is adapted for raising and lowering a tubular string with a BOP and/or subsea tree to the seabed;

a storage deck, located at the first side of the tower, the storage deck flanking at least part of the moonpool on opposite sides thereof, and which storage deck is provided on each side of the moonpool with a BOP storage area and with a subsea tree storage area, a working deck, located at the first side of the tower and above the storage deck, which working deck extends in the longitudinal direction of the moonpool, and, when seen in top view, is located between the storage positions, such that the BOP storage areas and subsea tree storage areas are open at the top to respectively accommodate a BOP or subsea tree having a height larger than the height between the storage deck and the working deck, and which working deck has a front section facing the tower and a rear section facing away from the tower, wherein the front section of the working deck is provided with a deck opening for passing a tubular supported in the firing line through the deck, a BOP transport system, configured for transporting a BOP between a storage position at the BOP storage area and a launch position above the moonpool, in which launch position the BOP is located in the firing line and can be manipulated by the hoisting device, which BOP transport system comprises:

a BOP cart for each BOP storage position; and a BOP track, which BOP track comprises two parallel rails, being a tower rail located adjacent the tower and a storage rail located between the BOP storage positions and the subsea tree storage positions, which rails are supported by the hull such that they bridge the moonpool in a direction perpendicular to the longitudinal axis of the moonpool, which rails support the BOP carts such that they can be moved between a storage position for supporting a BOP in its storage position and a firing line position for supporting a BOP in its launch position;

a subsea tree transport system, configured for transporting a subsea tree between a storage position at the subsea tree storage area and a launch position above the moonpool, in which launch position the subsea tree is located in the firing line and can be manipulated by the hoisting device, which subsea tree transport system comprises:

a moonpool cart;

a moonpool track, which moonpool track comprises two parallel rails that extend on opposite sides of the moonpool parallel to the longitudinal axis thereof, which rails support the moonpool cart such that it can be moved in said longitudinal direction between a receiving position located between the subsea tree storage positions and a firing line position for supporting a subsea tree in its launch position, and;

a subsea tree loading device, configured for moving a subsea tree form its storage position onto the moonpool cart and from the moonpool cart into its storage position;

wherein the BOP track is positioned above the moonpool track and crosses the moonpool track such that the firing line passes between the two rails of the BOP track and between the two rails of the moonpool track, and wherein the storage rail of the BOP track comprises a removable rail section, which removable rail section crosses the moonpool track and can be removed to enable a subsea tree to be moved by the subsea tree transport system along the moonpool track, wherein the working deck is a mobile working deck, configured to be moved between a working position, a BOP transporting position, and a subsea tree transporting position, in which working position the working deck is located with its front end adjacent the tower such that the firing line extends through the deck opening, and in which position the working deck blocks movement of BOPs along the BOP track and blocks movement of the subsea trees along the moonpool track, In which BOP transporting position the working deck clears the BOP track, such that it provides room for a BOP to be transported by the BOP transport system into its launch position above the moonpool, and in which position the working deck blocks movement of a subsea tree along the moonpool track, In which subsea tree transporting position the working deck clears the BOP track and the moonpool track such that it provides room for a subsea tree to be moved by the subsea tree transport system into its launch position above the moonpool.

According to the second aspect of the invention, a drilling vessel is provided with multiple storage positions for subsea devices, in particular BOPs and subsea trees. This is made possible by providing the vessel with a storage deck flanking the moonpool, which storage deck is provided on each side of the moonpool with a BOP storage area and with a subsea tree storage area, in combination with a working deck, located above the storage deck and between the storage positions on opposite sides of the moonpool, such that the BOP storage areas and subsea tree storage areas are open at the top to respectively accommodate a BOP or subsea tree having a height larger than the height between the storage deck and the working deck.

Because the working deck is configured to be moved between a working position, a BOP transporting position, and a subsea tree transporting position, and because the section of the storage rail of the BOP track that crosses the moonpool track is a removable rail section, the subsea trees as well as the BOPs can be moved efficiently between their storage position and their launching position in the firing line.

The storage areas being provided on the storage deck below the working deck, and on opposite sides of the working deck, in combination with the storage areas being open at their top side, allows for storing the BOPs and subsea trees in combination with a low working deck, a working deck positioned comparatively close to the water line, and allows for storing subsea trees and BOPs in an assembled state.

On known drilling vessels a subsea tree is often stored on the main deck, which is often substantially level with the working deck, in a disassembled state to keep the height, and thus the center of gravity, of the subsea trees close to the waterline while the subsea tree is stored. Thus, when the subsea tree is to be employed, it is assembled. Only then it can be tested to check if it is fully functional. The assembly and testing takes up a lot of time.

In a drilling vessel according to the second aspect of the invention, the subsea trees are stored partially below the working deck, which allows for them to be stored in their assembled stated without significantly moving their center of gravity away from the waterline, or even with their center of gravity closer to the waterline, compared to known drilling vessels. According to the second aspect of the invention, the subsea trees can be stored in an assembled state, which allows them to be stored tested, and thus obviates (thorough) testing just prior to employment. The subsea trees can thus be stored ready for use, which is not possible with prior art vessels without raising the center of gravity of the subsea trees. Also, a drilling vessel according to the second aspect of the invention provides BOP storage areas on opposite sides of the firing line, in combination with a working deck that does not require use of the firing line hoisting system to be moved into a BOP transporting position and a Subsea tree transporting position to allow for moving respectively a BOP or subsea tree between its storage position and the firing line.

The second aspect of the invention thus provides a drilling vessel able to transport multiple subsea devices, i.e. BOPs and subsea trees, in a ready for use configuration and stored in such that they can efficiently be moved between their storage position and their launching position in the firing line.

It will be appreciated that the mobile working deck according to the second aspect of the invention is configured to, when in its working position, support the weight of the suspended string of tubulars in combination with a BOP and/or subsea tree. In a practical embodiment said weight will be at least 200 tonnes. Therefore, a working deck according to the second aspect of the invention has a structure able to support a string of tubulars, e.g. risers, possibly with a BOP and/or subsea tree attached to the lower end of the string, having a weight of at least 200 tonnes.

In an embodiment according to the second aspect of the invention, the working deck is a mobile working deck, configured to be moved substantially parallel to the longitudinal axis of the moonpool, by partially or wholly being lifted, folded or slid, or a combination thereof, between its working position, its BOP transporting position, and its subsea tree transporting position. This allows for a compact configuration of the working deck and the storage positions provided on opposite sides of the working deck, and thus for storing multiple BOPs and subsea trees such that they can be moved between their storage position and their launch position in the firing line efficiently, i.e. with a minimum of preparation time and/or with a minimum of transfers between transporting devices and/or over a minimum distance, without the working deck or sections thereof blocking the tower and/or the hoisting system.

In an embodiment, the working deck is moved in a direction away from the tower, by partially or wholly being lifted, folded or slid, or a combination thereof, when being converted from its working position into its BOP transporting position and/or its subsea tree transporting position.

The second aspect of the invention thus allows for storing multiple BOPs and subsea trees such that they can be moved between their storage position and their launch position in the firing line efficiently, i.e. with a minimum of preparation time and/or with a minimum of transfers between transporting devices and/or over a minimum distance, without the working deck or sections thereof blocking the tower and/or the hoisting system.

Furthermore, moving the working deck from its working position in a direction away from the tower, frees up the first side of the tower above the BOP transport track, more in particular above the rails of the BOP transport track. Thus, the deck, when not in its working position, does not form an obstruction for the hoisting device of the hoisting system, which enables the hoisting device to further lower a supported object, for example lower a BOP onto a cart provided below deck above the moonpool. For example, when according to the prior art a mobile working deck is provided that is lifted into its non-active position and lowered into its active position, the working deck cannot clear the first side of the tower and thus limits the range of the hoisting device.

Furthermore, when the hoist system is provided with guides, for example guide rails or I-beams, for guiding the hoisting device in a vertical direction along the first side of the tower, providing a working deck that is moved away from the tower when not in its working position allows for those guides to extend below the working deck level. The guides can thus extend in a downward direction towards, preferably end adjacent, the guides of the BOP transport track. By allowing the guides to extend below the working deck level such that they end at the BOP transport track, the range of the hoisting device is further increased.

Thus, the second aspect of the invention also provides a working deck that allows for making optimum use of a firing line hoist system of an offshore drilling vessel, in particular provides an improved mobile working deck configured for use with a firing line hoist system of an offshore drilling vessel.

In an embodiment of an offshore drilling vessel according to the second aspect of the invention, the vessel furthermore has a main deck for storing equipment and/or tubulars, which main deck is provided at the aft of the vessel, and which main deck is adjacent to and flush with the working deck when the latter is in its working position, such that objects can be moved in a horizontal direction from the main deck onto the working deck.

Thus, when the working deck is in its working position a large size integral deck, comprising both the working deck and the main deck, is available for work and the efficient transport of equipment between storage positions on the main deck.

In a further embodiment, the main deck is provided with transport rails for supporting carts to transport objects over the main deck, and wherein the working deck is provided with transport rails, which, when the working deck is in its working position, are in line with transport rails provided on the working deck such that a cart can be driven over the transport rails from the main deck onto the working deck and vice versa.

In a further embodiment, the main deck extends along the tower towards the front of the vessel and at the second side of the tower. This allows for further efficient transport of tools and equipment.

In an embodiment of an offshore drilling vessel according to the second aspect of the invention, the front section of the working deck is a heavy duty section, configured for supporting a riser string in the firing line preferably with a BOP and/or a subsea tree attached to the lower end of the riser string, which heavy duty section of the working deck is supported by the rails of the BOP track when the working deck is in its working position.

In a further embodiment, the front section of the working deck is provided with support beams on opposite sides of the deck opening, the support beams extending in the longitudinal direction of the moonpool when the working deck is in its working position, and support cross beams preferably are directly supported by the rails of the BOP track when the working deck is in its working position. Thus, the working deck is configured to make optimal use of the BOP track which is typically configured to support large loads, and can comparatively easy be adapted to for supporting the additional loads of a heavy duty working deck.

In a further embodiment, the working deck comprises a suspension device for supporting a riser string, which suspension device supported by the support beams, such that a load supported by the suspension device is transferred directly from the suspension device to the support beams. The suspension device can thus be integrated in the working deck, thus not taking up any deck surface and providing optimal work space on the working deck. In an embodiment of an offshore drilling vessel according to the second aspect of the invention, the rails of the BOP track are heavy duty rails, configured for together supporting two BOP's of each at least 200 tons, and preferably for at the same time supporting the heavy duty section supporting a riser, of the working deck.

In an embodiment of an offshore drilling vessel according to the second aspect of the invention, the two rails sections of the storage rail of the BOP track, which are located between the BOP storage areas and the subsea tree storage areas on opposite sides of the moonpool, are supported such that they can each carry at last half the weight of a BOP when the removable rail section has been removed. Thus, the storage rail of the BOP track can be used for supporting the BOPs in their storage position, and for guiding the BOP carts when moving the BOPs between their storage position and their launching position. In an alternative embodiment, the BOP are secured to the frame of the hull or otherwise supported when in their storage position, such that a larger section of the storage rail or even the entire storage rail can be removed when a subsea tree is to be moved along the moonpool track.

In an embodiment of an offshore drilling vessel according to the second aspect of the invention, the removable rail section of the storage rail of the BOP track is pivotable connected with one of the two rails sections that are provided between the BOP storage areas and the subsea tree storage areas on opposite sides of the moonpool, to enable the removable rail section to be pivoted out of its position and into its position between the two rails sections that are provided between the BOP storage areas and the subsea tree storage areas on opposite sides of the moonpool. This allows for an efficient way for moving the rail section.

In an embodiment, the rail section, when in position, is at its opposed ends supported by the other two rail sections. This allows for an optimal efficient coupling with a direct weight transfer between the removable rail section and the other two rail sections which are supported by the hull and frame supported by the hull.

In an embodiment of an offshore drilling vessel according to the second aspect of the invention, the working deck is configured to be lifted out of its working position and to be lowered into its working position as a whole, to thus convert the working deck into its BOP transporting position and/or its subsea tree transporting position, for example by a crane such as an overhead crane. Using a crane allows for lifting the deck in an upward direction out of its working position, which in turn facilitates providing a minimal gap between the working deck and the tower and/or deck, for example main deck, located adjacent the working deck when in its working position.

In an alternative embodiment of a drilling vessel according to the second aspect of the invention, the working deck is a sliding working deck, configured for being slid as a whole into the longitudinal direction of the moonpool to convert the working deck into its BOP transporting position and its subsea transporting position. In such an embodiment, the working deck is preferably slid onto a deck surface of a deck adjacent the rear end of the working deck when the working deck is converted into its BOP transporting position or its subsea tree transporting position. For example a winch can be used for pulling the working deck out of its working position In such an embodiment, when sliding a working deck that is provided in a recessed position when in its working position, to level the working deck top surface with the top surface of a deck adjacent the working deck and thus provide a flush deck surface, the working deck and/and or a support of the working deck adjacent to the rear end of the working deck are provided with a rounded or angled skid surface to facilitate pulling the working deck upwards out of its recessed position and onto the deck. In an alternative embodiment, a frame is provided at the rear end of the working deck for receiving and supporting the working deck when pulled out of its working position.

In an embodiment, the working deck is pulled out its working position by a drive, for example a drive with a sprocket wheel for cooperating with a rack provided at the bottom side of the working deck. In an alternative embodiment, the deck is skidded into and out of its working position. Other solutions and/or drives for sliding the working deck into and out of its working position, and in some embodiments in and out of its recessed working position, can also be used. For example hydraulic cylinders can be used.

When the working deck is configured for being moved as a whole, the working deck preferably has a frame that extent over the entire length of the working deck. In an embodiment the frame comprises support beams that extent over the entire length of the working deck, which support beams are, when the working deck is in its working position, supported by the BOP track at the front end of the working deck, and are support by for example a cross beam or frame connected to the hull at the rear end of the working deck.

In an embodiment of an offshore drilling vessel according to the second aspect of the invention, the front section and the rear section of the working deck are hingeable connected.

In a further embodiment, the two deck sections are hingeable connected such that the front section of the working deck can be pivoted upward over an angle of about 90 degrees relative to the rear deck section, between a horizontal position and an inactive upright position, and the working deck can be converted into its BOP transporting position by pivoting the front section of the deck in the upright position, in which the front section of the working deck clears the BOP track such that a BOP can be transported by the BOP transport system into its launch position above the moonpool.

In an alternative embodiment, the two deck sections are hingeable connected such that the front section of the working deck can be pivoted upward over an angle of about 180 degrees relative to the rear deck section, between a horizontal position and an inactive horizontal position in which its folded adjacent the top surface of the rear section of the working deck, and wherein the working deck can be converted into its BOP transporting position by pivoting the front section of the deck in a folded position adjacent the top surface of the rear section of the working deck, in which folded position the front section of the working deck clears the BOP track such that a BOP can be transported by the BOP transport system into its launch position above the moonpool.

In a further embodiment, the vessel furthermore has a main deck for storing equipment and/or tubulars, which main deck is provided at the aft of the vessel, and which main deck preferably is adjacent to and flush with the working deck when the latter is in its working position, and wherein the rear section of the working deck is configured for being slid onto the main deck, while the front section of the working deck has been pivoted into its inactive position, to convert the working deck into its subsea tree transporting position.

In a further embodiment of an offshore drilling vessel according to the second aspect of the invention, the rear section of the working deck is hingeable connected to a rear support of the working deck, such that the rear section of the working deck can be pivoted upward, over an angle of at least 90 degrees, while the front section of the working deck has been pivoted upward into its inactive position, to convert the working deck into its subsea tree transporting position.

In a further embodiment, the two deck sections are hingeable connected such that the front section of the working deck can be pivoted downward relative to the rear section of the deck, over an angle of about 180 degrees relative to the rear deck section, into an inactive position in which its folded adjacent the bottom surface of the rear section of the working deck, and wherein the rear section of the working deck is hingeable connected to a rear support of the working deck, such that the rear section of the working deck can be pivoted upward, over an angle of at least 90 degrees, while the front section of the working deck is being pivoted into its inactive position adjacent the bottom surface of the rear deck section, to convert the working deck into its BOP transporting position and its subsea tree transporting position. In such an embodiment, the deck assumes the shape of an inverted V while being converted into its BOP transporting position, and assumes the shape of an I, with both decks folded against each other and in the upright position, when it has been converted into subsea tree transporting position. In a further embodiment, the folded deck is hinged into a substantially horizontal position, in which it rests on a deck adjacent to the working deck when the latter is in its working position, for example a main deck provided on the aft of the offshore drilling vessel. In a further embodiment of an offshore drilling vessel according to the second aspect of the invention, the rear section of the working deck, and optionally the front section of the working deck which is hingeable connected to the rear section, is/are provided with engagement devices, such as hooks or loops, for engagement by a lifting device, preferably a crane, for example an overhead crane, to enable the lifting device to engage the rear section, and optionally the rear section and the front section, of the working deck, to lift, move and lower the working deck into its subsea tree transporting position.

In an embodiment of an offshore drilling vessel according to the second aspect of the invention, the vessel is provided with mobile working deck support rails for supporting the working deck while it is slid in the longitudinal direction of the moonpool, which working deck support rails during use extend in the longitudinal direction of the moonpool and bridge the gap between the tower rail and the storage rail of the BOP track and/or bridge the gap between the storage rail of the BOP track and a main deck provided on the opposite side of the subsea tree storage areas. These working deck support rails can support the working deck, in particular the front end of the working deck, when the deck is pulled out of its working position into its BOP transporting position and its subsea tree transporting position. This is especially useful when the working deck is also pulled out of a working position in which its deck top surface is level with the deck top surface the working deck is pulled up and onto. In such an embodiment the working deck typically is supported by its front end while being pulled out of its working position, which front end can thus be guided and supported by the working deck support rails.

In a further embodiment, the mobile working deck support rails are pivotable supported, such that they can be removed by pivoting them in an upright position to allow the BOPs to be moved into the firing line and/or the subsea trees to be moved onto the moonpool cart when the working deck has been converted into its BOP transporting position and its subsea tree position respectively.

It is noted that when the working deck, or parts thereof are configured for being slid into and/or out of specific positions, such as a working position or a BOP transporting position, the working deck is preferably provided with skid surfaces for providing a slide contact with for example guide rails and/or a support frame when the working deck is moved.

Preferably, the skid surfaces are integral with a frame constituting the backbone of the working deck, i.e. a frame providing the working deck with constructional stiffness, preferably a frame that also transfers weight loads of a riser string and/or a BOP and/or a subsea tree supported by the working deck in the firing line, directly to the rails of the BOP track.

In an embodiment of an offshore drilling vessel according to the second aspect of the invention, the front section or the rear section of the working deck is a slideable deck section, or the front section and the rear section are slideable deck sections. Again, it is noted that when the working deck, or parts thereof are configured for being slid into and/or out of specific positions, such as a working position or a BOP transporting position, the working deck is preferably provided with skid surfaces for providing a slide contact with for example support rails and/or a support frame when the working deck is moved.

In a further embodiment, the vessel is provided with mobile working deck support rails for supporting the front section and/or the rear section of the working deck while it is/they are slid in the longitudinal direction of the moonpool to convert the working deck from its working position into its BOP transporting position and/or its subsea tree transporting position, which working deck support rails during use extends in the longitudinal direction of the moonpool and bridge the gap between the tower rail and the storage rail of the BOP track and/or bridge the gap between the storage rail of the BOP track and a main deck provided on the opposite side of the subsea tree storage areas.

In a further embodiment, the mobile deck support rails are pivotable supported, such that they can be removed by pivoting them in an upright position to allow the BOPs to be moved into the firing line and/or the subsea trees to be moved onto the moonpool cart when the working deck has been converted into its BOP transporting position and its subsea tree position respectively.

In a further embodiment, the front section of the working deck is configured to be slid onto the rear section of the working deck to convert the working deck into its BOP transporting position.

In a further embodiment, the rear section of the working deck is configured to be slid, optionally while supporting the front section of the working deck, onto a main deck adjacent the subsea tree storage position, which main deck preferably is flush with the working deck when the latter is its working position.

In a further embodiment, the two slideable deck section are connected, such that when the front section is slid onto a main deck adjacent the subsea tree storage position, which main deck preferably is flush with the working deck when the latter is its working position, the front section of the working deck is slid into the previous position of the rear working deck section, and the working deck is thus converted into its BOP transporting position.

In a further embodiment, when the rear section of the working deck is slid further onto the main deck, the front section of the working deck is also slid onto the main deck and the working deck is converted into its subsea tree transporting position. In such an embodiment the hingeable coupled deck sections form some sort of train, which facilitates pulling the hingeable connected deck sections onto a deck surface of a main deck, which deck surface is level with, or located higher than, the deck surface of the working deck when in its working position.

In an embodiment of an offshore drilling vessel according to the second aspect of the invention, a control room is located on the working deck, preferably on the rear section of the working deck. The control room is preferably equipped to house staff for monitoring and/or controlling the working processes on the working deck, and or operation of the hoisting system, etc, at least when the working deck is in its working position, and preferably also when the working deck is in its BOP transporting position and/or in its subsea tree transporting position.

In a further embodiment, the control room is moveably supported on the working deck, for example is supported on rails extending in the longitudinal direction of the moon pool, such that the control room can be moved between a position on the front section of the working deck and a position on the rear section of the working deck, for example to be moved onto the rear section of the working deck when the front section of the working deck is pivoted into an upright position to convert the working deck into its BOP transporting position.

In an alternative embodiment, the control room is provided on the rear section of the working deck, and is supported at such a height above the working deck, that the front section of the working deck can be slid onto the rear section of the working deck, below the control room supported on that rear section of the working deck.

In an alternative embodiment, the control room is supported by a hingeable mast or segmented arm, for example similar to the arm of a knuckle boom crane, which mast or arm is mounted on the hull of the vessel such that the control room can be supported above the working deck and can keep that position and/or allows for adjusting that position while the working deck is converted into its BOP transporting position and/or its subsea tree transporting position.

In an embodiment of an offshore drilling vessel according to the second aspect of the invention, the deck opening is part of a slot shaped opening, the slot shaped opening comprising two slideable support devices, which slideable support devices can be moved into and out of the firing line when the deck is in its working position, and which support devices thus define the deck opening when in the firing line.

In an embodiment of an offshore drilling vessel according to the second aspect of the invention, the deck opening is part of a slot shaped opening, the slot shaped opening extending up to a frontal edge of the working deck, the working deck thus comprising two leg parts on opposite side of the slot shaped opening and thus providing the front section of the working deck with a U-shape, such that a tubular can be moved in a lateral direction via said slot into the deck opening.

In a further embodiment, at least the frontal section of the working deck is hingeable supported such that it can be pivoted about a pivot axis perpendicular to the longitudinal axis of the moonpool, and wherein the slot shaped opening allows for pivoting at least the working section from a non-active upright position into an active horizontal position while a tubular is supported in the firing line, to thus receive said tubular in the deck opening via the elongate slot between the two leg parts.

In a further embodiment, the U-shaped front section of the working deck is pivotally supported such that it can be pivoted about a working deck pivot axis, which working deck pivot axis extends parallel to the rails of the BOP track and is provided at a distance from the tower such that, when the working deck is in its working position, the BOP track extends between the pivot axis and the tower, and wherein a working deck pivot drive is provided that can pivot the working deck about said pivot axis between:

an active position, in which the U-shaped working deck front section rests on the rails of the BOP track, and extends in a substantially horizontal direction such that it covers a portion of the moonpool while the firing line extends through the elongate slot at the closed end thereof, and a non-active position, in which the U-shaped working deck front section clears the BOP track and extends in a substantially vertical direction such that it provides room for a BOP to be moved by the BOP transport system into its launch position above the moonpool between the tower and the working deck, and wherein the working deck is pivotally supported, such that when the U-shaped working deck section is pivoted from its non-active position into its active position while a tubular is supported in the firing line, the tubular is received in the elongate slot between the two leg parts.

In a further embodiment, the U-shaped working deck section comprises at least two support beams, which support beams extend parallel to the legs of the U-shaped working deck on opposite sides of the elongate slot, and wherein the support beams rest directly on one of, preferably on both of, the rails of the BOP track, when the U-shaped working deck section is in its working position.

In a further embodiment, the U-shaped working deck section comprises movable deck parts, for example in the form of a removable hatch or a sliding deck part, for, when the deck section is in its active position, covering part of the elongate slot while keeping the elongate slot near its closed end uncovered to enable a tubular supported in the firing line to pass through the elongate slot at the closed end thereof.

In an embodiment of an offshore drilling vessel according to the second aspect of the invention, the removable rail section of the storage rail of the BOP track is configured to be lifted out of and lowered into place, for example by a crane such as an overhead crane, between the two rails sections that are provided between the BOP storage areas and the subsea tree storage areas on opposite sides of the moonpool.

In an alternative embodiment, the removable rail section is connected to the working deck, or to a section of the working deck, and the working deck and rail section are configured such that the rail section is removed with the working deck when the latter is moved from its BOP transporting position to its subsea tree transporting position.

In an alternative embodiment, the removable rail section is pivotable connected with one of the two rails sections that are provided between the BOP storage areas and the subsea tree storage areas on opposite sides of the moonpool, to enable the rail section to be pivoted out of and into place between the two rails sections that are provided between the BOP storage areas and the subsea tree storage areas on opposite sides of the moonpool.

In an alternative embodiment, the removable rail section is configured to be slid out of and slid into place.

In an embodiment of an offshore drilling vessel according to the second aspect of the invention, the subsea tree loading device comprises:

a subsea tree cart for each subsea tree storage position, a subsea tree track at each subsea tree storage position, which subsea tree tracks each comprise two parallel rails for supporting an subsea tree cart, which rails extend in a direction perpendicular to the longitudinal axis of the moonpool to enable, when the moonpool cart is located in its receiving position, the subsea tree carts to be moved between a storage position for supporting an subsea tree in its storage position and a transport position located on the moonpool cart.

In an alternative embodiment, the subsea tree loading device is configured for use with subsea trees comprising a cart, which cart is a component of the subsea tree, and wherein the subsea tree loading device comprises a subsea tree track at each subsea tree storage position, which subsea tree tracks each comprise two parallel rails for supporting a tree cart of a subsea tree, which rails extend in a direction perpendicular to the longitudinal axis of the moonpool to enable, when the moonpool cart is located in its receiving position, the subsea trees to be moved between their storage position and a transport position in which they are located on the moonpool cart.

In an alternative embodiment, the subsea tree loading device comprises an overhead crane, which overhead crane, when positioned over the subsea tree storage positions, can lift a subsea tree and move that tree between its storage position and the moonpool cart.

In an embodiment of an offshore drilling vessel according to the second aspect of the invention, the moonpool track supports additional carts for moving equipment, riser strings, or tubes along the moonpool, and optionally, wherein the moon pool cart is configured for transporting equipment, riser strings, or tubes along the moonpool.

In an embodiment of an offshore drilling vessel according to the second aspect of the invention, the working deck and/or the vessel are provided with locking devices for securing the working deck, preferably for securing both the front and the rear section of the working deck, in the working position In an embodiment of an offshore drilling vessel according to the second aspect of the invention, actuators, such as one or more hydraulic cylinders and/or one or more drives, are provided for pivoting the deck sections of the working deck relative to each other and/or relative to the vessel.

In an embodiment of an offshore drilling vessel according to the second aspect of the invention, actuators, such as one or more hydraulic cylinders, one or more drives, one or more winches, are provided for sliding the deck sections of the working deck relative to each other and/or relative to the vessel.

In an embodiment of an offshore drilling vessel according to the second aspect of the invention, the front section and/or the rear section of the working deck comprise multiple sections which sections are hingeable connected such that the sections can be pivoted relative to each other, for example be folded upon each other, to adjust the shape and/or size of the deck sections, for example to enable the front deck section to be folded onto the rear deck section adjacent a control room provided on that rear deck section.

In an embodiment of an offshore drilling vessel according to the second aspect of the invention, the front section and/or the rear section of the working deck comprise sections which can be removed independently from the deck sections themselves, for example comprise deck sections which are pivotable connected to the tower or the hull of the vessel and which can be pivoted in for example an upright non active position while the deck section it belongs to is to be slid in the longitudinal direction of the moonpool to convert the working deck into its BOP transporting position or its subsea tree transporting position.

In an embodiment of an offshore drilling vessel according to the second aspect of the invention, wherein the BOP carts have a support frame that is provided with a lateral opening that allows for a tubular, for example a riser held by the hoisting device and supporting a BOP, to be moved, in a lateral direction, into or out of the BOP support frame.

In an embodiment of an offshore drilling vessel according to the second aspect of the invention, the rails of the BOP track are provided in the form of beams that cross the moonpool, and that are supported by the hull on opposite sides of the moonpool, and wherein at least one of the guiderails of the BOP track is provided with a guide surface for supporting and guiding the at least one BOP cart and with a separate support surface for supporting the working deck.

In an embodiment of an offshore drilling vessel according to the second aspect of the invention, the base of the tower is connected to the hull of the drilling vessel at the moonpool at opposite sides thereof, such that at least the first side of the tower and preferably also the second side of the tower bridges the moonpool in a lateral direction thereof.

In an embodiment of an offshore drilling vessel according to the second aspect of the invention, the off shore drilling vessel is a monohull drilling vessel, the monohull having an elongate shape extending along a longitudinal axis, and wherein the longitudinal axis of the moonpool is parallel to the longitudinal axis of the monohull drilling vessel.

In an embodiment of an offshore drilling vessel according to the second aspect of the invention, the drilling vessel further comprises:

- a riser tensioner system adapted to be connected to a top end of a riser string, in order to suspend the riser string from in the second firing line; and/or
- a suspended riser transfer device, comprising:
  - a riser hang-off assembly
  - a gimbal device; and
  - a frame supporting both the riser hang-off assembly and the gimbal device, which frame is moveably supported for movement along the longitudinal axis of the moonpool, preferably is movably supported by the moonpool track.

The second aspect of the invention furthermore provides a method for riser string handling using an offshore drilling vessel according to one or more of the preceding claims.

A further method according to the second aspect of the invention comprises the step of lowering a BOP or a subsea tree from the offshore drilling vessel, wherein the mobile working deck is moved in its BOP transporting direction or subsea tree transporting position respectively, and the BOP or subsea tree is brought into the first firing line thus cleared by the mobile working deck.

Advantageous embodiments of the vessel according to the first aspect of the invention and the method according to the first aspect of the invention are disclosed in the sub claims.

Advantageous embodiments of the vessel according to the first aspect of the invention and the offshore drilling vessel according to the second aspect of the invention and the methods according to the first and second aspect of the invention are disclosed in the description, in which the invention is further illustrated and elucidated on the basis of a number of exemplary embodiments, of which some are shown in the schematic drawing.

Advantageous embodiments of the offshore drilling vessel according to the second aspect of the invention and the method according to the second aspect of the invention are disclosed in the clauses at the end of the description.

BRIEF DESCRIPTION OF THE DRAWINGS

In the drawings:

FIG. 15 *b-f* show a perspective view of the working deck of the drilling vessel of FIG. 13 in subsequent steps of being moved from its working position shown in FIG. 15*a* to its subsea tree transporting position shown in FIG. 15 *c*.

DETAILED DESCRIPTION OF THE DRAWINGS

Figure 1:
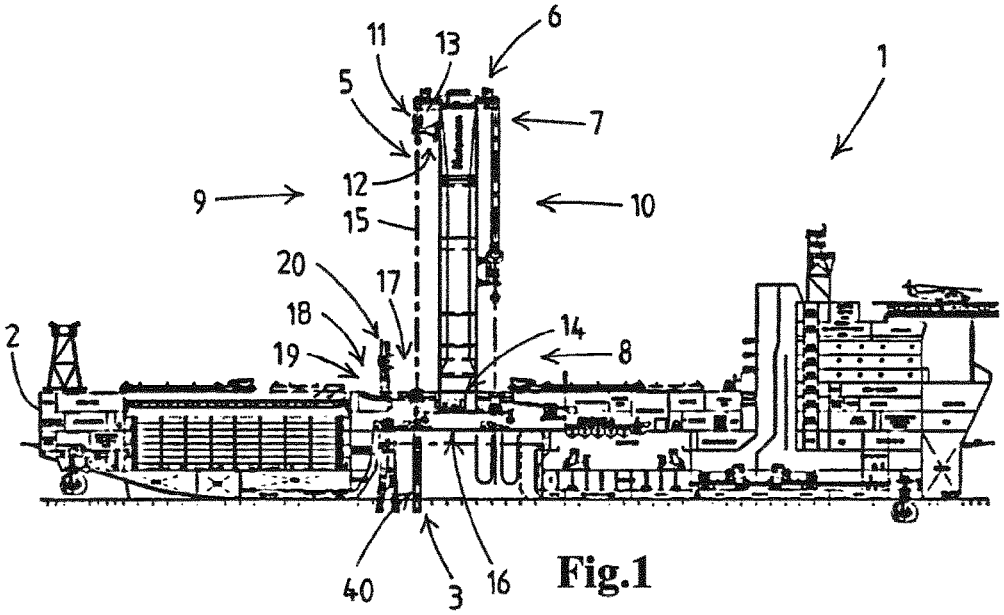
FIG. 1 shows a side view in cross section of an offshore drilling vessel with a first embodiment of a working deck according to the second aspect of the invention.
Figure 2:
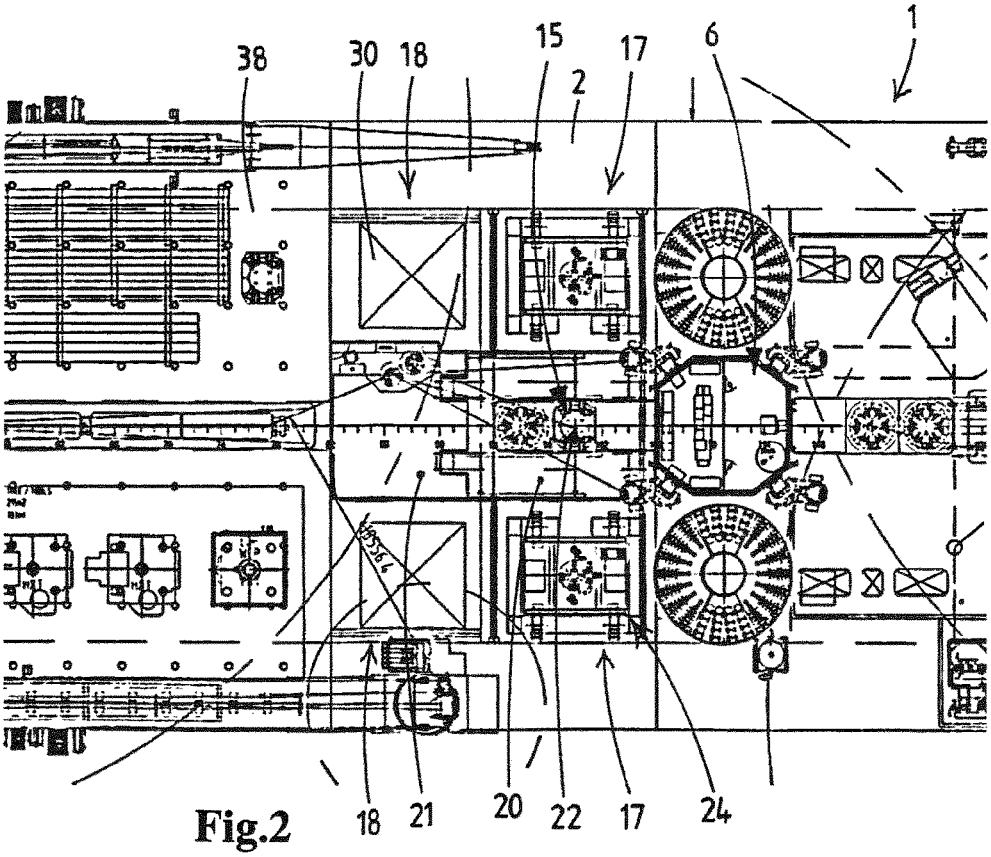
FIG. 2 shows a top view of a section of the offshore drilling vessel comprising the working deck of FIG. 1.

FIG. 1 shows a side view in cross section of an offshore drilling vessel 1 with a first embodiment of a working deck 16 according to the second aspect of the invention. FIG. 2 shows a top view of a section of the offshore drilling vessel 1 comprising the working deck 16 of FIG. 1.

The offshore drilling vessel 1 comprises a hull 2 having a moonpool 3. The moonpool has a longitudinal axis, which in the embodiment shown is parallel to a longitudinal axis of the drilling vessel. It is observed that in an alternative embodiment of a vessel according to the second aspect of the invention, the vessel, when seen in top view, may be provided with a square or circular shape not having a longitudinal axis.

According to the second aspect of the invention, the offshore drilling vessel 1 is provided with a firing line hoist system 5, the firing line hoist system being supported by the hull 2 of the drilling vessel 1. The firing line hoist system 5 comprises a tower 6 and a hoisting device 11.

The tower 6 is arranged at the moonpool 3. In the particular embodiment shown, the tower bridges the moonpool 3 which extends below the tower from the rear of the drilling vessel 1 towards the front of the drilling vessel 1.

The tower 6 has a top 7 and a base 8. The tower furthermore has a first side 9, in the embodiment shown facing the rear of the drilling vessel 1, and a second side 10, in the embodiment shown facing the front of the vessel. The base 8 of the tower 6 is connected to the hull 2 of the vessel 1 such that the first side 9 of the tower 6 faces the moonpool 3. It is noted that in the embodiment shown, the second side 10 of the tower 6 also faces the moonpool 3 because the tower bridges the moonpool.

The hoisting system 5 furthermore comprises a hoisting device 11 adapted for rising and lowering a tubular string with a BOP and/or subsea tree to the seabed. The hoisting device 11 comprises a load attachment device 12 displaceable supported by the tower, one or more cables 13 and one or more associated winches 14, in the embodiment shown provided at the base of the tower, to manipulate the position of the load attachment device relative to the tower in a vertical direction along a firing line 15.

The firing line 15 extends on the outside of tower 6 at the first side thereof. The firing line 15 extends through the moonpool 3.

The vessel 1 furthermore comprises a storage deck 16, located at the first side of the tower, the storage deck flanking at least part of the moonpool 3 on opposite sides thereof. The storage deck 16 is provided on each side of the moonpool 3 with a BOP storage area 17 and with a subsea tree storage area 18. It is noted that in the embodiment shown, the storage deck 16 extends along the full length of the moonpool. In alternative configurations, the storage deck extends along only a part of the length of the moonpool.

The vessel 1 furthermore comprises working deck 19, located at the first side of the tower 6 and above the storage deck 16. The working deck 19 extends in the longitudinal direction of the moonpool 3, and, when seen in the top view shown in FIG. 2, is located between the BOP storage areas 17 and the subsea tree storage areas 18.

Since, according to the second aspect of the invention, the working deck 19 is provided above and between the BOP storage areas 17 and subsea tree storage areas 18, the storage areas are open at the top and thus configured to respectively accommodate a BOP or subsea tree having a height larger than the height between the storage deck 16 and the working deck 19.

According to the second aspect of the invention, the working deck 19 has a front section 20 facing the tower 6 and a rear section 21 facing away from the tower 6. The front section 20 of the working deck 19 is provided with a deck opening 22 for passing a tubular supported in the firing line 15 through the working deck 19.

The vessel 1 furthermore comprises BOP transport system 23, configured for transporting a BOP 24 between a BOP storage position at the BOP storage area 17 and a launch position in the firing line 15 above the moonpool 3, in which launch position the BOP can be manipulated by the hoisting device 11.

The BOP transport system 23 comprises a BOP cart 25 for each BOP storage area 17, and a BOP track 26. The BOP track 26 comprises two parallel rails, being a tower rail 27 located adjacent the tower 6 and a storage rail 28 located between the BOP storage areas 17 and the subsea tree storage areas 18. The rails 27, 28 are supported by the hull 2 such that they bridge the moonpool 3 in a direction perpendicular to the longitudinal axis of the moonpool. The rails 27, 28 support the BOP carts 25 such that the cats can be moved between a storage position for supporting a BOP in the BOP storage area and a firing line position for supporting a BOP in its launch position.

The vessel 1 furthermore comprises a subsea tree transport system 29, configured for transporting a subsea tree 30 between a storage position in a subsea tree storage area and a launch position above the moonpool 3, in which launch position the subsea tree is supported in the firing line 15 and can be manipulated by the hoisting device 11.

The subsea tree transport system 29 comprises a moonpool cart 31 and a moonpool track 33 for the moonpool cart, and a subsea tree loading device 34.

The moonpool track 32 comprises two parallel rails 33 that extend on opposite sides of the moonpool 3 parallel to the longitudinal axis thereof. The rails 33 of the moonpool track 32 support the moonpool cart 31 such that the cart can be moved in the longitudinal direction of the moonpool, between a receiving position located between the subsea tree storage areas 18 and a firing line position for supporting a subsea tree in its launch position in the firing line 15 above the moonpool 3.

The subsea tree loading device 34 is configured for moving a subsea tree from its storage position in the subsea tree storage are into a transporting position on the moonpool cart 31 and, vice versa, from the moonpool cart 31 into its storage position.

The BOP track 26 is positioned above the moonpool track 32 and crosses the moonpool track such that the firing line 15 passes between the two rails 25, 26 of the BOP track 26 and between the two rails 33 of the moonpool track 32. This is aspect is also depicted in the schematic side views of FIGS. 4-6.

Figure 6:
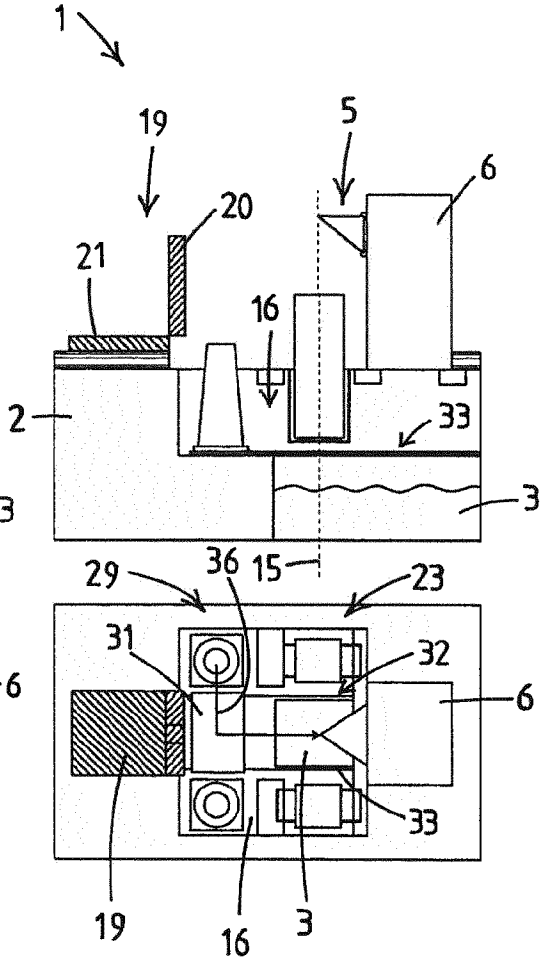
FIG. 6 shows a schematic side view and top view of a section of the offshore drilling vessel of FIG. 4, the working deck being in a subsea tree transporting position.
Figure 5:
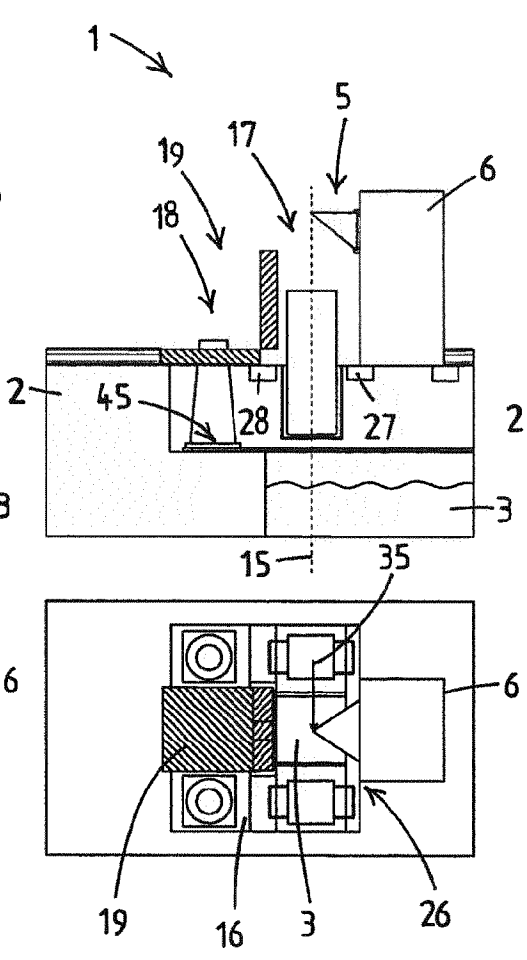
FIG. 5 shows a schematic side view and top view of a section of the offshore drilling vessel of FIG. 4, the working deck being in a BOP transporting position.
Figure 4:
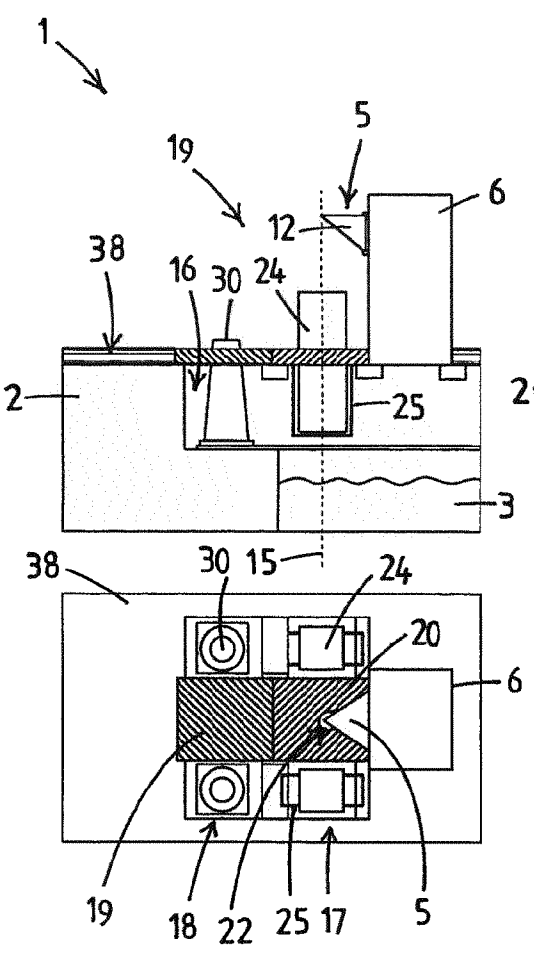
FIG. 4 shows a schematic side view and top view of a section of the offshore drilling vessel of FIG. 1, the working deck being in a working position.

According to the second aspect of the invention, the working deck 19 is a mobile working deck, configured to be moved between a working position, a BOP transporting position, and a subsea tree transporting position. FIGS. 4-6 show schematic side views and corresponding top views of a section of the offshore drilling vessel of FIG. 1, the working deck being positioned respectively in a working position, a BOP transporting position, and a subsea tree transporting position.

In the particular embodiment shown, the front section 20 and the rear section 21 of the working deck 19 are hingeable connected. The two deck sections are hingeable connected such that the front section of the working deck can be pivoted upward over an angle of about 90 degrees, between a horizontal position and an inactive upright position. The working deck is converted into its BOP transporting position by pivoting the front section of the deck into its upright position. In the embodiment shown, the working deck is subsequently converted into its subsea tree transporting position by sliding the deck, with the front section pivoted upwards, onto the rear deck of the vessel.

The different positions of the deck will now be further explained in reference to the FIGS. 4-6.

In the working position, shown in FIGS. 2 and 4, the working deck 19 is located with its front section 20 adjacent the tower 6 such that the firing line 15 extends through the deck opening 22. In this working position the working deck 19 blocks movement of BOPs 24 along the BOP track 26 and blocks movement of the subsea trees 30 along the moonpool track 32.

In the BOP transporting position, shown in FIG. 5, the working deck 19 clears the BOP track 26, such that it provides room for a BOP 24 to be transported by the BOP transport system 23 into its launch position above the moonpool 3. In this launch position the working deck 19 blocks movement of a subsea tree 30 along the moonpool track 32. In FIG. 6 the trajectory of movement of the BOP is indicated with arrow 35 for one BOP. It is noted that FIG. 1 shows the working deck in its BOP transporting position, the front section pivoted in its upright position.

Figure 3:
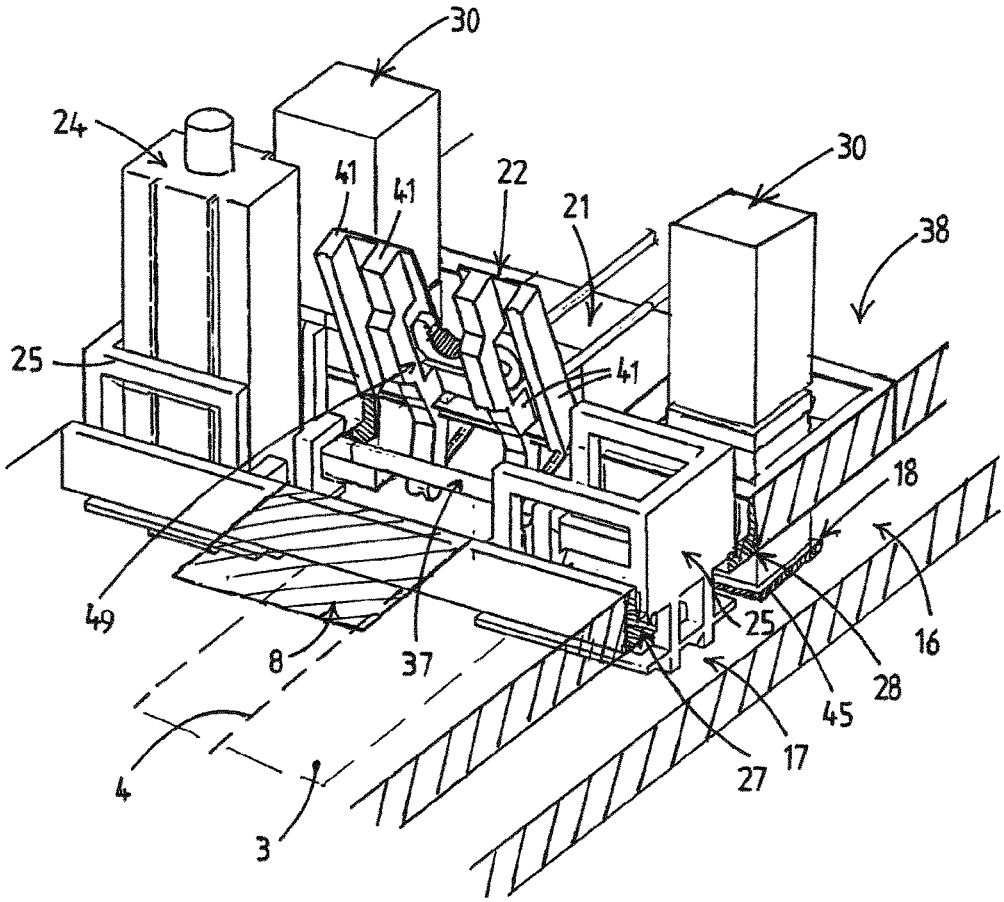
FIG. 3 shows a perspective view of a section of the offshore drilling vessel comprising the working deck of FIG. 1, the working deck being moved into a BOP transporting position.

FIG. 3 shows a perspective view of a section of the offshore drilling vessel 1 with the working deck 19 with the pivotable connected front section 20 being pivoted in an upward direction relative to the rear section 21 of the working deck. The figure only shows some of the components of the vessel, i.e. the working deck 19, the BOP transport system 23 and the subsea trees 30 in their storage position, while others have been omitted, such as the hull 2 and the tower 6.

In the subsea tree transporting position, shown in FIG. 6, the working deck 19 clears the BOP track 26 and the moonpool track 32 such that it provides room for a subsea tree 30 to be moved by the subsea tree transport system 29 into its launch position above the moonpool 3. In FIG. 6 this movement is indicated with arrow 36 for one subsea tree.

According to the second aspect of the invention, the storage rail 28 of the BOP track comprises a removable rail section 37, which removable rail section crosses the moonpool track 32 and can be removed to enable a subsea tree 30 to be moved by the subsea tree transport system 29 along the moonpool track 32. The removable rail section is present (and shown) in FIGS. 3, 4 and 5, and has been removed in FIG. 6.

In the embodiment shown in FIGS. 1-6, the front section 20 of the working deck 19 is a heavy duty section, configured for supporting a riser string 20, part of which is shown in FIG. 1, in the firing line 15 preferably with a BOP 24 and/or a subsea tree 30 attached to the lower end of the riser string. The heavy duty section of the working deck 19 is supported by the rails 27,28 of the BOP track 26 when the working deck 19 is in its working position.

Furthermore, the front section 20 of the working deck 19 is provided with support beams 41 on opposite sides of the deck opening 22, see FIG. 3. The support beams 41 extend in the longitudinal direction of the moonpool 3 when the working deck 19 is in its working position, and are directly supported by the rails 27,28 of the BOP track 26 when the working deck 19 is in its working position. Thus, the weight of the riser string and optionally the BOP and/or subsea tree attached thereto is transferred form the working deck onto the rails 27,28 of the BOP track 26. Thus optimal use is made of these rails, which by nature are configured for supporting heavy loads. It is noted that the working deck, more in particular the support beams of the working deck, may not be supported by the rails or skid surface that is actually used by the BOP carts, but may as an alternative engage a support surface provided on the support beam that supports the rails or skid surface that is actually used by the BOP carts.

In the embodiment shown, the working deck 19 comprises a suspension device 42 for supporting the riser string 40. The suspension device 42 is supported by the support beams 41, such that a load supported by the suspension device is transferred directly from the suspension device to the support beams, and via those support beams directly to the rails 27,28 of the BOP track 26.

The rails 27,28 of the BOP track 26 are heavy duty rails, configured for together supporting two BOP's of each at least 200 tons, and preferably for at the same time supporting the heavy duty section of the working deck supporting a riser. As set out above, these rails may also comprise support beams mounted on the hull of the vessel, for example essentially be such a cross beam provided with a skid surface for moveably supporting the BOP carts.

It is noted that the storage rail 28 of the BOP track shown comprises a central removable rail section 37 and two rail sections on opposite sides thereof, which two rail sections are each located between a BOP storage areas 27 and the subsea tree storage area 28, and which two rail sections are supported such that they can each carry at last half the weight of a BOP when the removable rail section 37 has been removed. The two rail sections can for example be supported by a frame that is in turn mounted on the hull of the vessel.

In the embodiment shown, the removable rail section 37 and the two rail sections on opposite sides thereof are configured such that the removable rail section 37 can be lifted out of its support position and lowered into its support position.

In an alternative embodiment, the removable rail section of the storage rail of the BOP track is pivotable connected with one of the two rails sections that are provided between the BOP storage areas and the subsea tree storage areas on opposite sides of the moonpool, to enable the rail section to be pivoted out of its position and into its position between the two rails sections that are provided between the BOP storage areas and the subsea tree storage areas on opposite sides of the moonpool The offshore drilling vessel 1 has a main deck 38 for storing equipment and tubulars. The main deck is provided at the rear end of the vessel, adjacent to and flush with the working deck 19 when the latter is in its working position. Thus, the working deck forms an integral part of the main deck when in its working position, and objects, such as equipment and tubulars, can be moved in a horizontal direction from the main deck onto the working deck.

The main deck provided may also provide space for parking the working deck, or a section thereof, when the working deck is in its BOP transporting position or in its subsea tree transporting position. To allow this it is not necessary for the main deck and the working deck to be flush when the latter is in its working position.

It is noted that the main deck may extend along the tower towards the front of the vessel and at the second side of the tower, which is the case with the vessel 1 shown. In alternative embodiments, the main deck is only provided at the rear end of the vessel and an auxiliary deck, i.e. a deck not directly connected and/or flush with the main deck, is provided at the front of the tower.

In the particular embodiment of the working deck 19 shown, the rear section 21 of the working deck 19 maintains its position when the front section 20 is pivoted in the upward direction to convert the working deck 19 into its BOP transporting position. Thus, when the working deck is in the Bop transporting position, the rear section of the working deck is still flush with the main deck.

It is noted that since the working deck is flush with the main deck when in its working position, sliding the working deck onto the main deck to convert the working deck into its subsea tree transporting position also involves moving the deck upwards. This can be achieved in different ways. For example, the main deck can be provided with one or more pivotable mounted sections that can be pivoted downward to provide a ramp for sliding the working deck onto the main deck. In an alternative embodiment the end of the working deck located adjacent the main deck can be lifted using a lifting device, such as a cylinder located below the deck for pushing the working deck or at least part thereof in the upward direction, after which the working deck can be slid onto the main deck. Different solutions for lifting or partially lifting the working deck to enable it to be moved onto the main deck are also possible, which solutions in view of this disclosure as such are not considered inventive, and thus are not elaborated upon in great detail.

Furthermore, the lifting of the deck to enable it to slide onto the main deck is considered part of the sliding process, and is thus not separately mentioned each time the sliding process is discussed.

The vessel 1 is furthermore on its main deck provided with transport rails for supporting carts to transport objects over the main deck. Furthermore, in the embodiment shown, the working deck 19 is provided with transport rails 39, depicted in FIG. 3, which transport rails, when the working deck is in its working position, are in line with transport rails provided on the main deck such that a cart can be driven over the transport rails from the main deck onto the working deck and vice versa.

It is noted that within the scope of the second aspect of the invention, many configurations of the working deck are possible. For example, the front section and the rear section can be hingeable connected such that the deck sections can be pivoted relative to each other. In another embodiment, the front section and the rear section of the working deck are rigidly connected, such that the working deck forms a single rigid working deck which is to be manipulated as a whole. In yet another embodiment, the front section and the rear section are separate sections which can be manipulated separately. Furthermore, the front section and the rear section of the deck can comprise sub sections, which can be manipulated independently of the main sections, and/or can be connected, for example hingeable connected, to the main section. Other configurations of the working deck are also possible.

Also, the second aspect of the invention allows for different ways of manipulating the working deck and/or the deck sections thereof. For example, the working deck can be configured to be lifted as a whole, for example by an overhead crane, to be converted into the BOP transporting position and the subsea tree transporting position. Alternatively, only the front deck section can be configured to be lifted to convert the working deck into its BOP transporting position, while the rear deck section is configured for being slid to convert the working deck into its subsea tree transporting position. In most cases the working deck will be located on a main deck when the working deck is in its subsea tree transporting position, which main deck is located at the rear of the storage areas, i.e. the tower and the main deck, or at least a section thereof, being provided on opposite sides of the BOP an subsea tree storage areas.

Figure 9:
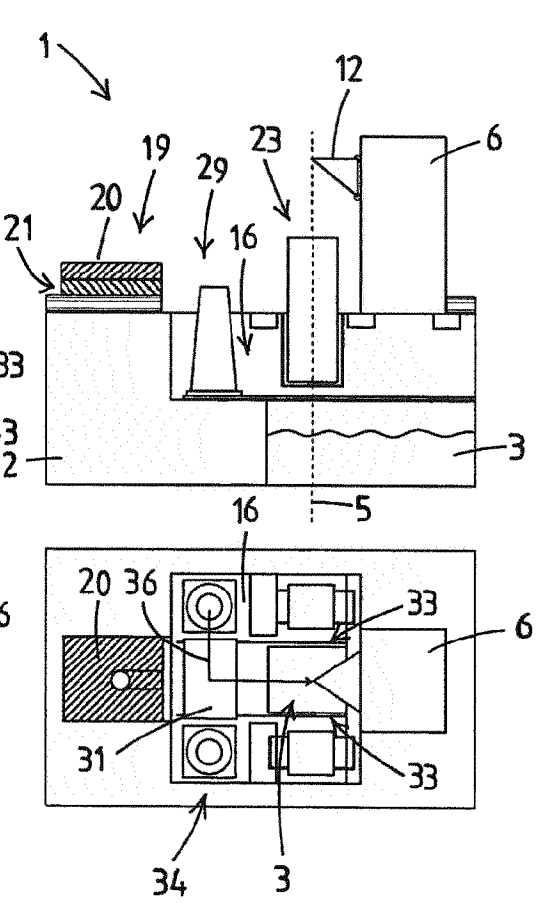
FIG. 9 shows a schematic side view and top view of the section of the offshore drilling vessel of FIG. 7, the working deck being in a subsea tree transporting position.
Figure 8:
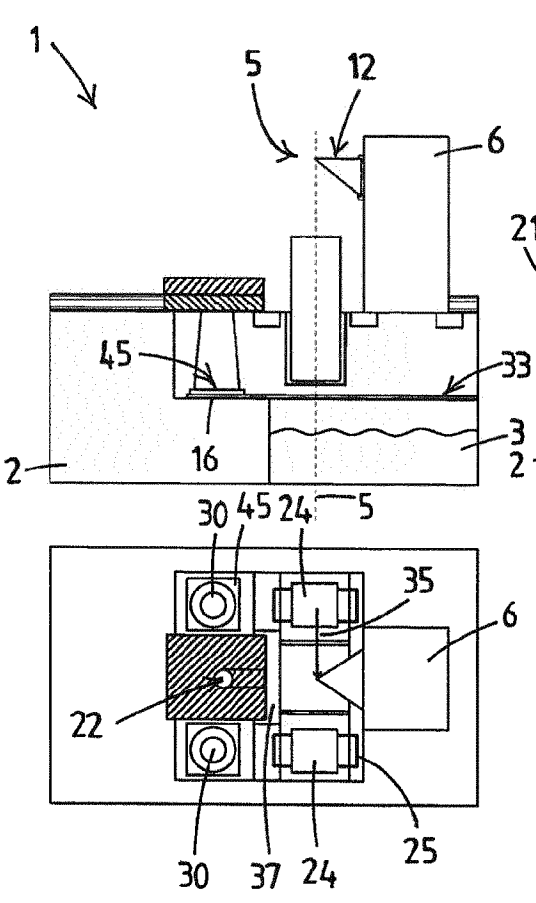
FIG. 8 shows a schematic side view and top view of the section of the offshore drilling vessel of FIG. 7, the working deck being in a BOP transporting position.
Figure 7:
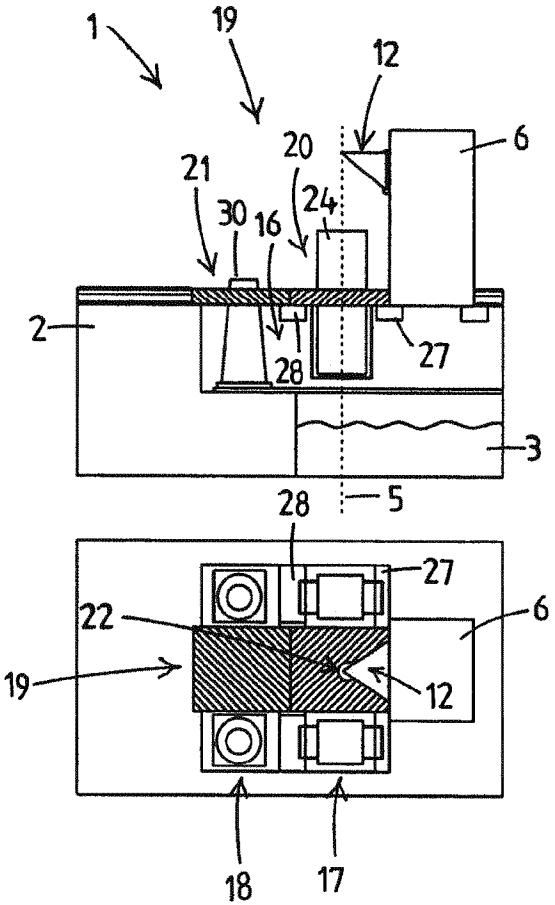
FIG. 7 shows a schematic side view and top view of a section of a second offshore drilling vessel comprising a working deck according to the second aspect of the invention, the working deck being in a working position.

In an embodiment according to the second aspect of the invention the front section and the rear section of the working deck are separate deck sections that can be moved relative to each other. FIGS. 7-9 show a section of an offshore drilling vessel, for example similar to the one shown in FIG. 1, wherein the working deck sections are separate deck sections which can be moved separately. Components similar to the ones already discusses with respect to FIGS. 1-6 have been provided with the same reference signs as used in FIGS. 1-6.

FIG. 7 shows a schematic side view and a top view of the working deck 19 in its working position, in which it is flush with the main deck 38.

FIG. 8 shows a schematic side view and top view of the working deck 19 being in a BOP transporting position, which is achieved by lifting the front section 20 of the working deck 19, for example using an overhead crane, and lowering it onto the rear section 21 of the working deck.

FIG. 9 shows a schematic side view and top view of the working deck 19 being in a subsea tree transporting position, which is achieved by sliding both deck sections 20,21 onto the main deck 38 to free up the subsea tree transport system 29 and allow for moving subsea trees between their storage area and the firing line.

It is noted that in an alternative embodiment, the front section and the rear section of the working deck are hingeable connected such that the front section of the working deck can be pivoted upward over an angle of about 180 degrees relative to the rear deck section, between a horizontal position and an inactive horizontal position in which its folded adjacent the top surface of the rear section of the working deck. Thus the configuration shown in FIG. 8 can be achieved by pivoting the front section of the working deck relative to the rear section. Subsequently, the working deck can be converted into its subsea tree transporting position by for example lifting and moving the deck sections onto the main deck suing an overhead crane. Alternatively, the rear section of the working deck is hingeable mounted to the hull of the vessel, such that both the rear deck section, and the front deck section folder onto it, can be pivoted in an upward direction, over an angle of about 90 degrees relative to the main deck, and into an upright position to convert the working deck into its subsea tree transporting position.

Figures 10, 11, 12:
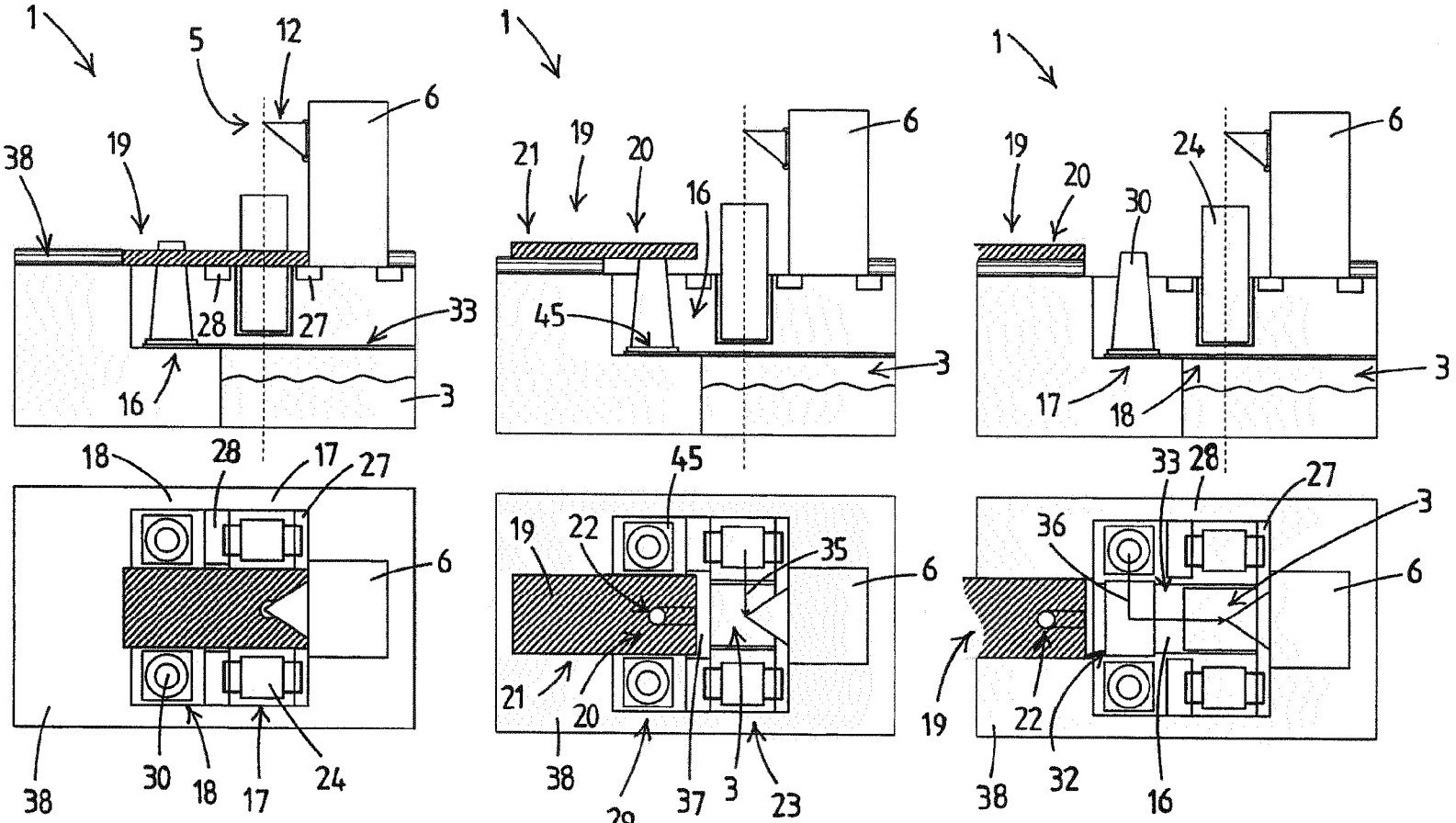
FIG. 10 shows a schematic side view and top view of a section of a third offshore drilling vessel comprising a working according to the second aspect of the invention, the working deck being in a working position.
FIG. 11 shows a schematic side view and top view of the section of the offshore drilling vessel of FIG. 10, the working deck being in a BOP transporting position.
FIG. 12 shows a schematic side view and top view of the section of the offshore drilling vessel of FIG. 10, the working deck being in a subsea tree transporting position.

In another embodiment according to the second aspect of the invention the front section and the rear section of the working deck are rigidly connected, such that they form a single, rigid working deck, of which the deck sections cannot be moved relative to each other. FIGS. 10-12 show a section of an offshore drilling vessel, for example similar to the one shown in FIG. 1, wherein the working deck sections 20,21 are rigidly connected and the working deck 19 is moved as a whole when converted between its working position, BOP transporting position and subsea tree transporting position. Components similar to the ones already discusses with respect to FIGS. 1-9 have been provided with the same reference signs as used in FIGS. 1-9.

FIG. 10 shows a schematic side view and a top view of the working deck 19 in its working position, in which it is flush with the main deck 38.

FIG. 11 shows a schematic side view and top view of the working deck 19 being in its BOP transporting position, which is achieved by lifting the whole working deck, for example using an overhead crane, and lowering it with its rear section onto main deck.

FIG. 12 shows a schematic side view and top view of the working deck 19 being in its subsea tree transporting position, which is achieved by lifting the working deck and moving it further onto the main deck 38 to free up the subsea tree transport system 29.

It is noted that in an alternative embodiment, the working deck 19 is to be slid onto the main deck 38. In such an embodiment, the main deck 38 can be provided with a deck section that can be lowered, more in particular pivoted, such that a ramp is created for sliding the working deck onto the main deck.

Figure 13:
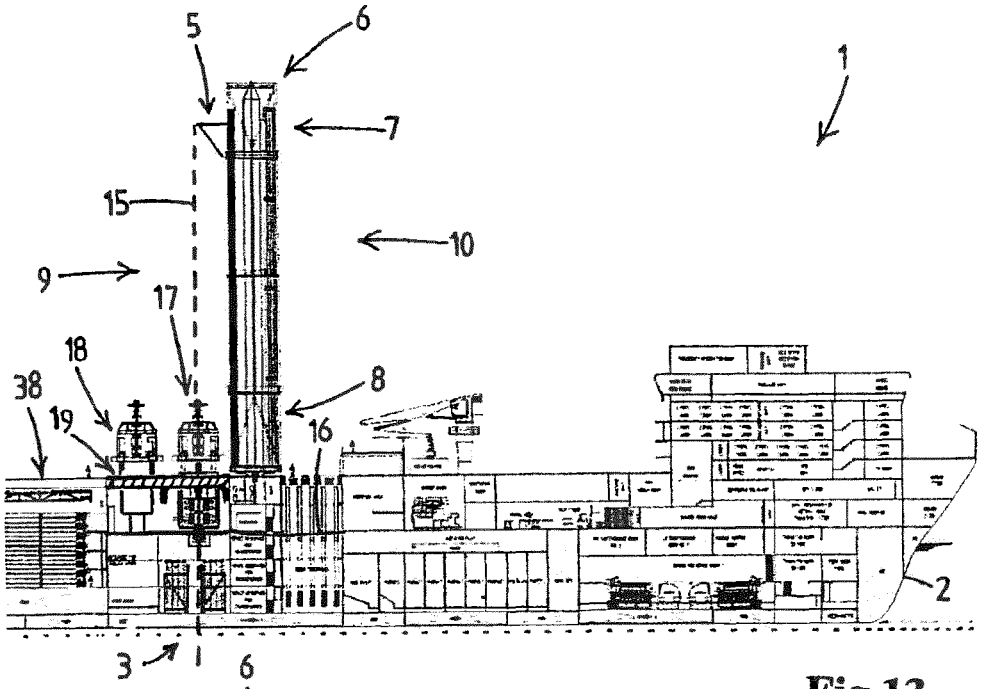
FIG. 13 shows a side view in cross section of an offshore drilling vessel with a working deck according to the second aspect of the invention, which working deck is in its working position.
Figure 14:
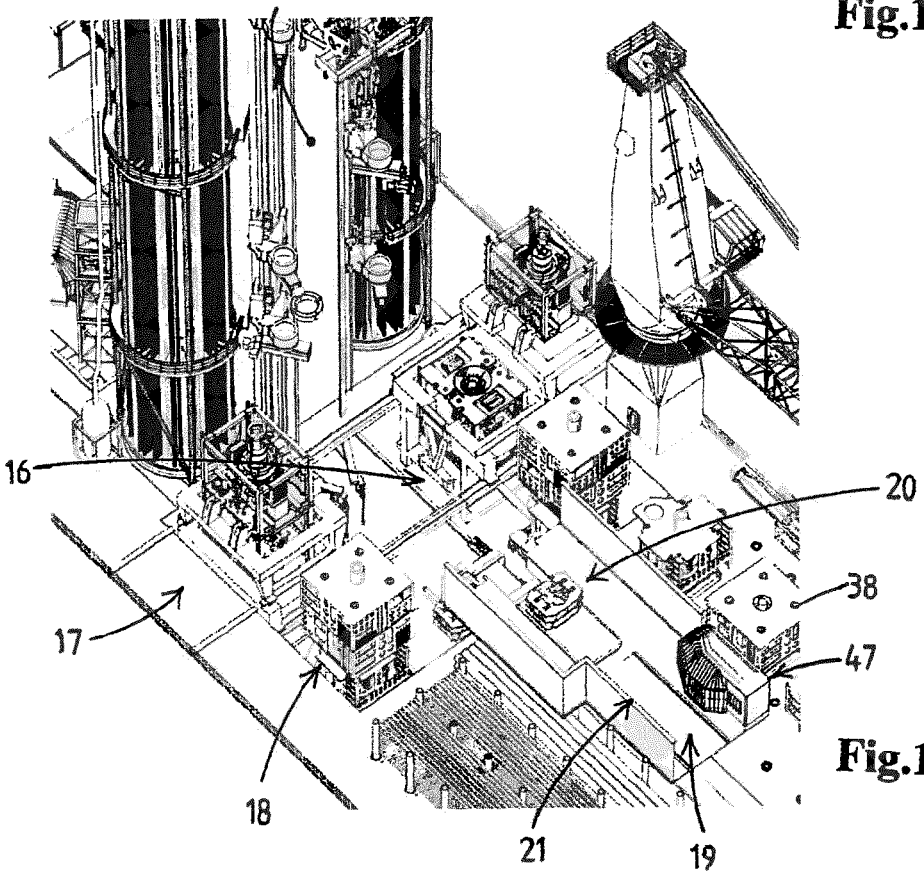
FIG. 14 shows a perspective view of a section of the offshore drilling vessel of FIG. 13, with the working deck moved into a subsea tree transporting position.

In yet another embodiment, the working deck is slid onto the main deck using a lifting device, for example a lifting frame. Such an embodiment is shown in FIGS. 13-15. Components similar to the ones already discusses with respect to FIGS. 1-12 have been provided with the same reference signs as used in FIGS. 1-12.

FIG. 13 shows a side view in cross section of an offshore drilling vessel 1 with its working deck 19 in its working position. FIG. 14 shows a perspective view of a section of the offshore drilling vessel of FIG. 13, with the working deck 19 moved into a subsea tree transporting position. FIG. 15 *a* shows a perspective view with reduced detail of a section of the offshore drilling vessel of FIG. 13, with the working deck in its working position. In this figure for example the tower and the hull of the vessel have not been depicted. Furthermore, in contrast with the working depicted in FIGS. 13 and 14, the working deck is provided with a screen along its longitudinal sides that forms a barrier between the persons on the working deck and the storage areas, when the working deck is in its working position.

Figure 15A:
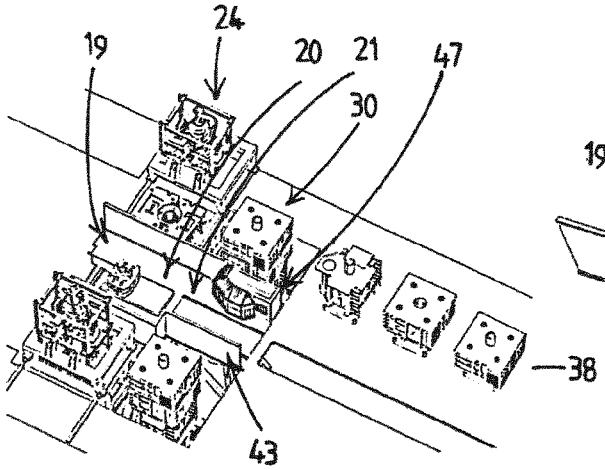
FIG. 15 *a* shows a perspective view with reduced detail of a section of the offshore drilling vessel of FIG. 13, with the working deck in its working position.

FIGS. 15 *b-f* show a perspective view of the working deck 19 depicted in FIG. 15*a*, in subsequent steps of being moved from its working position shown in FIG. 15*a* to its subsea tree transporting position shown in FIG. 15 *f*.

Figure 15B:
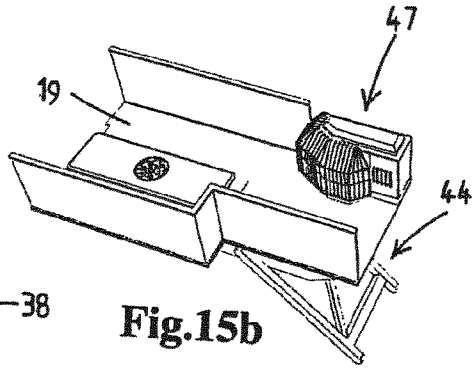
Figure 15C:
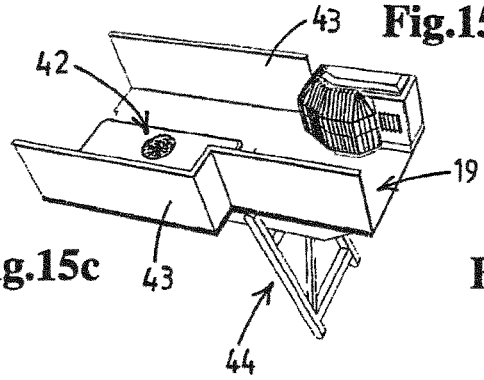
Figure 15D:
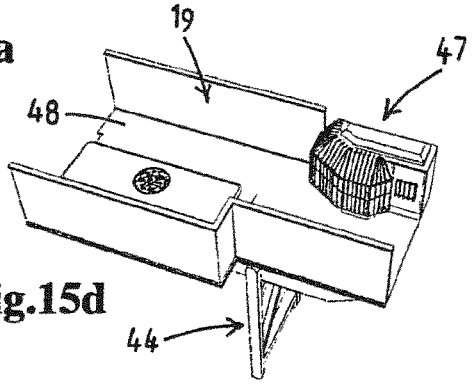
Figure 15E:
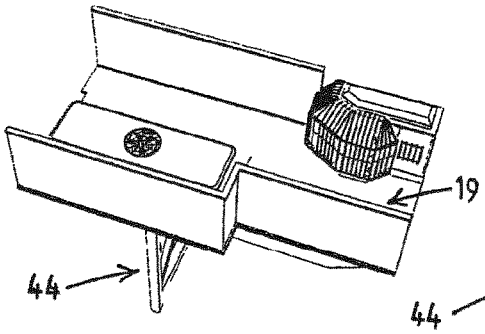
Figure 15F:
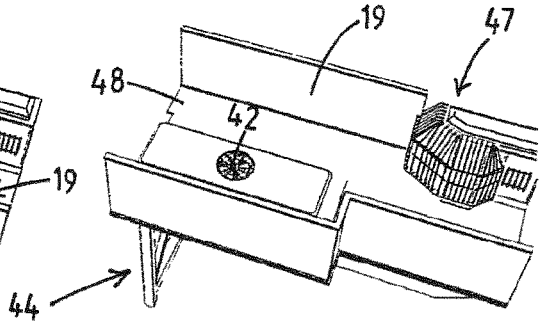

In the embodiment shown, the working deck is provided with a lifting frame 44 configured for lifting one end of the working deck to enable sliding the working deck 19 onto the main deck 38 to convert the working deck into its BOP transporting position and its subsea tree transporting position. The lifting frame is at one end pivotable mounted to the storage deck, or to a section of a load bearing frame adjacent the storage deck, and is at its opposite end pivotable mounted in two guide elongate guide openings provided in the loadbearing frame of the working deck. The load bearing frame and the guide openings are configured such, that when the deck is in its working position, the frame stands at an angle with the vertical. This condition is shown in FIG. 15*b*. It is noted that the lifting frame 44 is located beneath the rear section 21 of the working deck 19. When the lifting frame 44 is subsequently pulled into a vertical, i.e. an upright position, the working deck 19 is pushed upwards at one end, lifting that end of the working deck above the deck surface of the adjacent main deck. At the same time, the working deck is moved away in a direction away from the tower, which is shown in FIGS. 15*c* and 15*d*. Thus one end of the working deck is lifted out of its working position, in which the deck surface of the working deck was substantially flush with the deck surface of the working deck, and into a position above the main deck. Now the working deck can be slid or pulled further onto the main deck to fully convert the working deck into its BOP transporting position. This condition is shown in FIG. 15*e*. Finally the deck is slid fully onto the main deck to convert it into its subsea tree transporting position. This configuration is shown in FIG. 15 *f*.

In an embodiment, wires and winches are sued for pulling the working deck into and out of its working position. In alternative embodiments, drives and/or hydraulic cylinders can be used, optionally in combination with linkage mechanisms.

The working deck shown in FIGS. 15*a*-5 is configured as a sliding working deck, configured for being slid as a whole into the longitudinal direction of the moonpool to convert the working deck into its BOP transporting position and its subsea transporting position. It is however noted that the lifting frame shown in FIGS. 15*a-f* can also be sued to only move the rear section of the working deck, for example in combination with a front section of the working deck that is hingeable connect to the rear section of the working deck and is configured for being pivoted over an angle of 180 degrees into a position onto the rear section of the working deck to convert that working deck into its BOP transporting position.

In a further embodiment of a working deck configured as a sliding working deck, the vessel is provided with mobile working deck support rails for supporting the working deck while it is slid in the longitudinal direction of the moonpool, which working deck support rails during use extend in the longitudinal direction of the moonpool and bridge the gap between the tower rail and the storage rail of the BOP track and/or bridge the gap between the storage rail of the BOP track and a main deck provided on the opposite side of the subsea tree storage areas. Thus at least the trailing end of the working deck can be supported if need, while that end of the working deck is being moved.

In a further embodiment, the mobile working deck support rails are pivotable supported, such that they can be removed by pivoting them in an upright position to allow the BOPs to be moved into the firing line and/or the subsea trees to be moved onto the moonpool cart when the working deck has been converted into its BOP transporting position and its subsea tree position respectively.

It is observed that in the embodiments shown in FIGS. 4-12 the subsea tree loading device, for moving the subsea trees 30 onto the moonpool cart 31, comprises a subsea tree cart 45 for each subsea tree storage position, and a subsea tree track 47 at each subsea tree storage position. The subsea tree tracks each comprise two parallel rails for supporting a subsea tree cart 45, and extend in a direction perpendicular to the longitudinal axis of the moonpool. When the moonpool cart 31 is located in its receiving position, shown in FIGS. 6, 9 and 12, the subsea tree carts 45 can be moved over the subsea tree tracks between a storage position, in which position they are shown in FIGS. 6, 9 and 12, for supporting an subsea tree in its storage position, and a transporting position located on the moonpool cart (not shown). The moonpool cart is therefore configured for supporting one subsea tree cart carrying a subsea tree.

In an alternative embodiment, the subsea tree loading device is configured for use with subsea trees comprising a cart, which cart is a component of the subsea tree, and wherein the subsea tree loading device only comprises the sub tree tracks at each subsea tree storage position. The subsea tree tracks each comprise two parallel rails for supporting a tree cart of a subsea tree, which rails extend in a direction perpendicular to the longitudinal axis of the moonpool to enable, when the moonpool cart is located in its receiving position, the subsea trees to be moved between their storage position and a transporting position in which they are located on the moonpool cart.

In another embodiment, the subsea tree loading device comprises an overhead crane, which overhead crane, when positioned over the subsea tree storage positions, can lift a subsea tree and move that tree between its storage position and a position on the moonpool cart.

In the embodiments shown a control room 47 is located on the working deck 19. The control room is depicted in FIGS. 2, 14 and 15*a-f*. Such a control room can be used for monitoring and controlling the action on the working deck, the hoisting system, the movement of the working deck, the transport of the BOPs and/or subsea trees, etc.

The control room 47 is located in a fixed position on the rear section 21 of the working deck 19. Thus, the control room is moved with the working deck. The position on the rear section of the working deck is for example beneficial when the deck sections are hingeable connected and the working deck is pivoted in an upright position to convert the working deck into its BOP transporting position. In this condition the control room can remain fully functional when the deck is in its BOP transporting position.

In alternative embodiment, the control room can be movably supported on the working deck, for example on rails extending in the longitudinal direction of the moon pool, such that the control room can be moved between a position on the front section of the working deck and a position on the rear section of the working deck, for example to be moved onto the rear section of the working deck when the front section of the working deck is pivoted into an upright position to convert the working deck into its BOP transporting position.

In an alternative embodiment the control room is provided on the rear section of the working deck, and is supported at such a height above the working deck, that the front section of the working deck can be slid onto the rear section of the working deck, below the control room supported on that rear section of the working deck.

In yet another embodiment, the control room is supported by a hingeable mast or segmented arm, for example similar to the arm of a knuckle boom crane, which mast or arm is mounted on the hull of the vessel such that the control room can be supported above the working deck and can keep that position and/or allows for adjusting that position while the working deck is converted into its BOP transporting position and/or its subsea tree transporting position.

Other configurations and/or locations of the control room are also possible.

In the embodiment shown in FIG. 3, the deck opening 22 is part of a slot shaped opening, the slot shaped opening extending up to a frontal edge of the working deck 19. The working deck thus comprising two leg parts 48 on opposite side of the slot shaped opening and thus providing the front section of the working deck with a U-shape, such that a tubular can be moved in a lateral direction via said slot into the deck opening. The working deck is furthermore provided with a C-shaped clamping device for engaging and supporting a tubular. Thus, the pivotable mounted front deck section can be pivoted into and out of a horizontal position while a tubular is supported in the firing line to thus engage or disengage that tubular.

It is observed that the C-shaped clamping device 49 is slideable supported in the slot shaped opening, which comprises an additional, in this case O-shaped, clamping device 50, see FIG. 2. These two slideable support devices 49,50 can be moved into and out of the firing line when the working deck is in its working position. This configuration allows for efficiently changing the C-shaped tool for the O-shaped tool. It is noted that other types of tools, clamping devices, etc. can also be slideable supported in the working deck. In a further embodiment, the slideable supported tools can be replaced with other tools, and/or are mounted in a larger cassette or support frame that can be mounted into the working deck and be removed or replaced with another frame holding other tools.

In the embodiment of the working deck shown in FIG. 3, the U-shaped front section of the working deck is pivotally supported such that it can be pivoted about a working deck pivot axis, which working deck pivot axis extends parallel to the rails of the BOP track and is provided at a distance from the tower such that, when the working deck is in its working position, the BOP track extends between the pivot axis and the tower, and wherein a working deck pivot drive is provided that can pivot the working deck about said pivot axis between:

an active position, in which the U-shaped working deck front section rests on the rails of the BOP track, and extends in a substantially horizontal direction such that it covers a portion of the moonpool while the firing line extends through the elongate slot at the closed end thereof, and a non-active position, in which the U-shaped working deck front section clears the BOP track and extends in a substantially vertical direction such that it provides room for a BOP to be moved by the BOP transport system into its launch position above the moonpool between the tower and the working deck, and wherein the working deck is pivotally supported, such that when the U-shaped working deck section is pivoted from its non-active position into its active position while a tubular is supported in the firing line, the tubular is received in the elongate slot between the two leg parts.

Furthermore, the U-shaped working deck section comprises at least two support beams, which support beams extend parallel to the legs of the U-shaped working deck on opposite sides of the elongate slot, and which support beams rest directly on both of the rails of the BOP track, when the U-shaped working deck section is in its working position.

Furthermore, the U-shaped working deck section comprises movable deck parts, for example in the form of a removable hatch or a sliding deck part, for, when the deck section is in its active position, covering part of the elongate slot while keeping the elongate slot near its closed end uncovered to enable a tubular supported in the firing line to pass through the elongate slot at the closed end thereof.

From the foregoing, it will be clear to the skilled person, that within the framework of the second aspect of the invention as set forth in the claims also many variations other than the examples described above are conceivable. For instance, the drilling vessel floor structure according to the second aspect of the invention is furthermore suitable for building a drill string, clamping the drill string segments with wigs in the bushing.

In the embodiments shown, the working deck and storage locations are provided at the side of the tower facing the rear of the vessel. It is noted that the working deck and storage locations according to the second aspect of the invention can also be located at the side facing the front of the vessel. Furthermore, a vessel could be provided with a working deck and storage locations according to the second aspect of the invention on both sides of the tower.

In general, the working deck, more in particular its deck sections will consists of a frame of load carrying beams in combination with plate shaped coverings, which are mounted on the frame to provide a deck surface. In an alternative embodiment the deck, or a deck section, can be a box-shaped, the box being made from steel plates and providing the deck section with structural rigidity. The frame can also be sued for mounting actuators and/or as part of a linkage mechanism configured for lifting and/or pivoting the working deck and/or the working deck sections when the deck us converted into its BOP transporting position or its subsea tree transporting position.

In an embodiment, the rear deck section is box shaped and configured for telescopically receiving the front deck section. In another embodiment one or both deck sections can be received below the main deck, for example in a dedicated hold for receiving the working deck when the working deck is converted into its BOP transporting or its subsea tree transporting position.

FIGS. 16-24 depict a vessel with a working deck according to the first aspect of the invention. It is submitted that there are many similarities with aspects already disclosed above with respect to the vessel and working deck according to the second aspect of the invention. It is submitted that in particular the lay out of the vessel can be mostly the same with a working deck according to the first aspect of the invention and with the further embodiments of working decks disclosed above. Because of the many similarities in the lay out of the working deck and the vessel, similar reference signs have been used in the drawings (i.e. the reference signs used in FIGS. 1-15 plus hundred). Thus, in the figures, the last two digits of the reference numbers for elements that correspond in the various figures match. Once such an element has been described with respect to one figure, the description of that element is incorporated by reference into the descriptions of corresponding elements of other figures unless the text or context indicates otherwise.

Figures 16, 17, 18:
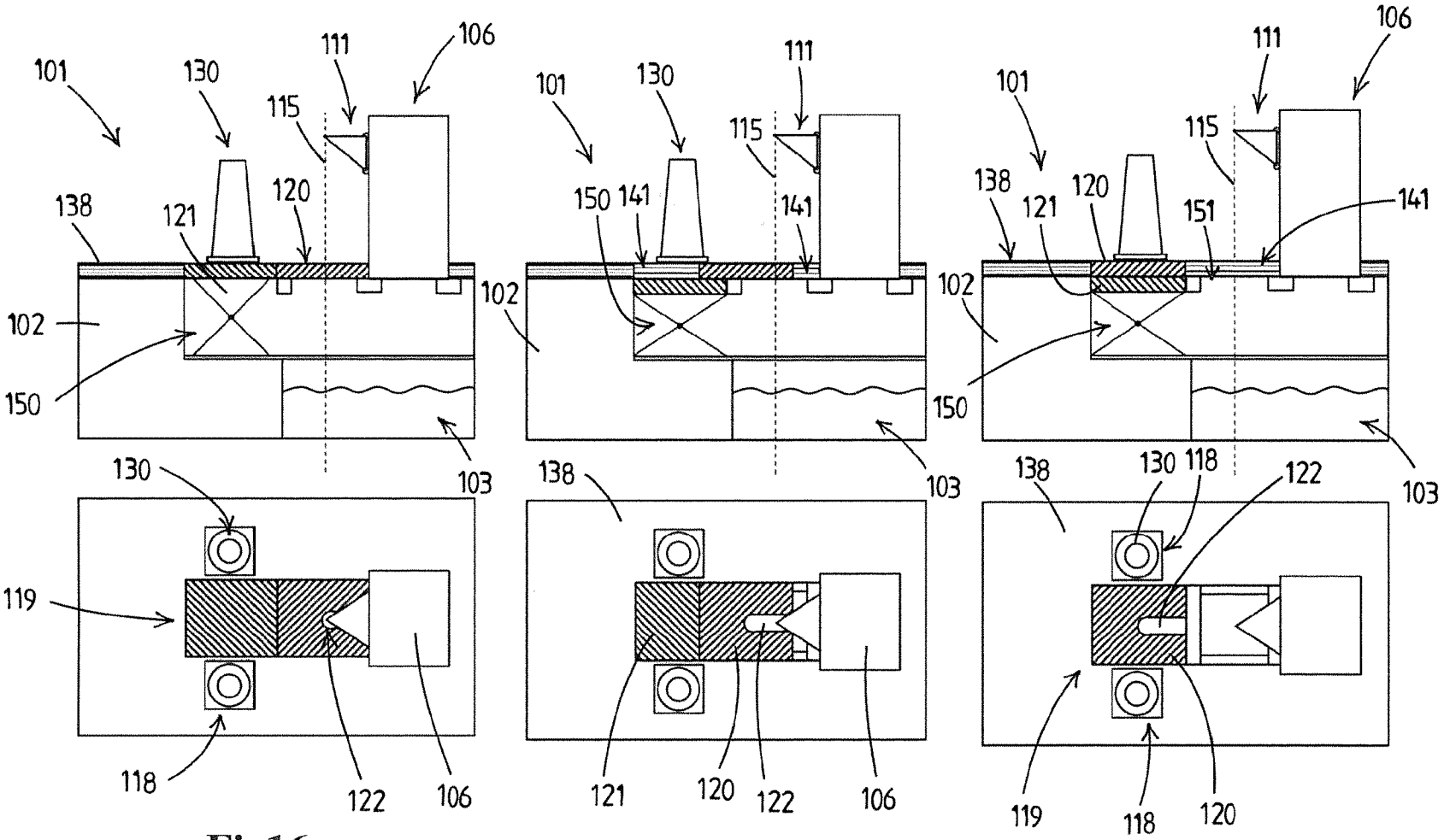
FIG. 16 shows a schematic side view and top view of a section of a first exemplary embodiment of a vessel according to the first aspect of the invention, the vessel having a mobile working deck in a working position.
FIG. 17 shows a schematic side view and top view of the vessel of FIG. 16, while the working deck is being converted into a transporting position.
FIG. 18 shows a schematic side view and top view of the vessel of FIG. 16, the working deck being in a transporting position.

FIG. 16-18 show a schematic side view and top view of a section of a first exemplary embodiment of a vessel 101 according to the first aspect of the invention. The vessel can be similar in lay out and function to the off shore drilling vessel shown in FIG. 1. It is submitted that a mobile working deck according to the first aspect of the invention can also be used with other types of vessels having a moon pool and a hoisting device for lowering equipment through the moonpool, for example with a vessel for well servicing.

According to the first aspect of the invention, the vessel 101 comprises:

- a hull 102 having a moonpool 103;
- a firing line hoist system 105 having a firing line 115 that extends through the moonpool 103;
- a stationary main deck 138 for storing equipment, such as subsea trees 103 and/or tubulars;
- a mobile working deck 119, comprising a front deck section 120 with a deck opening 122 for receiving the firing line 115 and a rear deck section 121 that is located adjacent the stationary main deck 138;
- a working deck rear section lift system 150; and
- a working deck front section guide system 151.

The firing line hoist system 105 is to be sued for supporting equipment and/or tubulars in the firing line 115, and to lift and lower equipment and/or tubulars out of and into the moonpool. Typically, the firing line hoist system 105 comprises a tower 106, and a hoisting device 111.

The tower 106 is arranged at the moonpool 103, and is connected to the hull 102 of the vessel 101. In some embodiments, the tower of the hoisting device may be located adjacent the moonpool while in other embodiments, the tower bridges the moonpool, or a part thereof.

The hoisting device 111 is adapted for raising and lowering equipment through the moonpool 103. The hoisting device 111 comprises a load attachment device, such as a hook or clamp, one or more cables and one or more associated winches to manipulate the position of the load attachment device relative to the tower in a vertical direction along a firing line 115. It is noted that for the sake of clarity, the load attachment device, cables and winches are not shown in the figures.

The rear deck section lift system 150 is configured for lifting and lowering the rear deck section 121, independent of the front deck section 120, between the working position and the transporting position. In the particular embodiment shown, the rear deck section lift system 150 is provided in the form of a scissors lift. However, many types of lifts can be used, for example a hydraulic lift, a jackscrew lift, or a rack and pinion lift.

Figures 19, 20, 21:
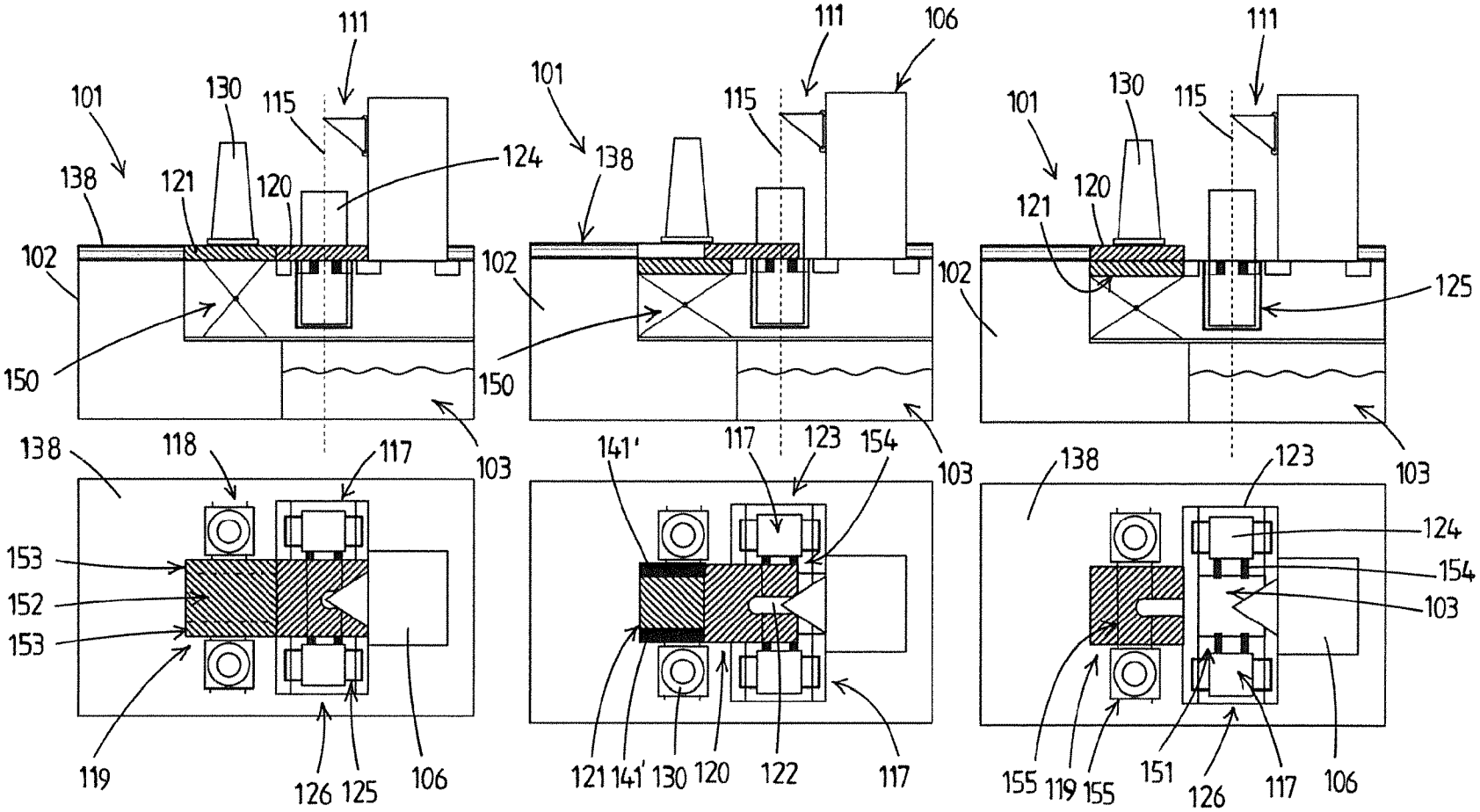
FIG. 19 shows a schematic side view and top view of a section of a second exemplary embodiment of a vessel according to the first aspect of the invention, the vessel having a mobile working deck in a working position.
FIG. 20 shows a schematic side view and top view of the vessel of FIG. 19, while the working deck is being converted into a transporting position.
FIG. 21 shows a schematic side view and top view of the vessel of FIG. 19, the working deck being in a transporting position.

FIG. 19 depicts the working deck rear section 121 in its raised working position, and FIG. 20 depicts the same working deck section lowered into the transporting position. according to the first aspect of the invention, by lowering the working deck rear section 121, are recess or opening is created for receiving the working deck front section 120.

The front deck guide system 151 is configured for guiding the working deck front section 120, independent of the rear deck section 121, in a substantially horizontal direction between the working position, depicted in FIG. 19, and the transporting position, depicted in FIG. 21. FIG. 20 shows the working deck front section 120 while it is being moved from the working position into the transporting position.

The working deck 119 is configured to be moved between a working position, depicted in FIG. 19, and a transporting position, depicted in FIG. 21.

When the working deck is in the working position, according to the first aspect of the invention, the front deck section 120 and the rear deck section 121 are located adjacent each other, with the working deck front section 120 located above the moonpool 103 and adjacent the tower 106 such that the firing line 115 extends through the deck opening 122 of the working deck front section 120.

When the working deck 119 is in the transporting position, according to the first aspect of the invention, the front deck section 120 is located above the rear deck section 121 and adjacent the stationary main deck 138.

The invention thus provides a two-part mobile working deck. According to a first aspect of the invention, the two part mobile working deck 119 in combination with the rear deck lift system 150 and the front deck guide system 151 allow for a compact configuration of the working deck 119 when in the transporting position. Thus, the working deck 119, in particular the working deck front section 120, can be located adjacent the moonpool 103 when in the transporting position. According to the first aspect, the invention thus provides an improved mobile working deck 119. Since the working deck 119 does not obstruct access to the moonpool, in other words is not a barrier for equipment being transported from the main deck to the moonpool, when in the transporting position, it allows for efficient transport of equipment from the main deck to the moonpool and vice versa.

In the preferred embodiment shown in FIGS. 119-121, the main deck 138 is flush with the working deck rear section 121 when the working deck 119 is in the working position, such that objects can be moved in a horizontal direction from the main deck 138 onto the working deck 119, and the working deck front section 120 is flush with the main deck 138 when the working deck 119 is in the transport position, such that objects can be moved in a horizontal direction from the main deck 138 onto the working deck front section 120 while in its transporting position.

The invention also provides a method for moving equipment, such as the subsea trees 130 or equipment stored on the stationary main deck 138, into the firing line 115, using the working deck front section 120 of the working deck 119 as a transport device.

The method comprises:

lowering the working deck rear section 121, independent of the working deck front deck section 120, from the working position into the transporting position, using the a rear deck lift system 150 (this is the position shown in FIGS. 17 and 20);

moving the working deck front section 120, independent of the working deck rear section 121, from the working position into the transporting position, in which the working deck front section 120 is located adjacent the main deck 138, using the front deck guide system 151 (this is the position shown in FIGS. 18 and 21);

moving equipment 130 form the main deck 138 onto the working deck front section 120;

moving the working deck front section 120, and the equipment located 130 thereon, independent of the working deck rear section 121, from the transporting position into the working position, in which the working deck front section 120 is again located adjacent the tower 106 and the equipment located on the working deck front section 120 is thus located in the firing line 115.

In a further method according to the invention subsequently;

the equipment is attached to the hoisting device using the load attachment device, the equipment is lifted by the hoisting device;

the working deck front section is again moved into the working position; and the equipment is lowered, by the hoisting device into the sea via the moonpool.

It is submitted that the working deck according to the invention can also be used for removing equipment out of the firing line.

Figure 22:
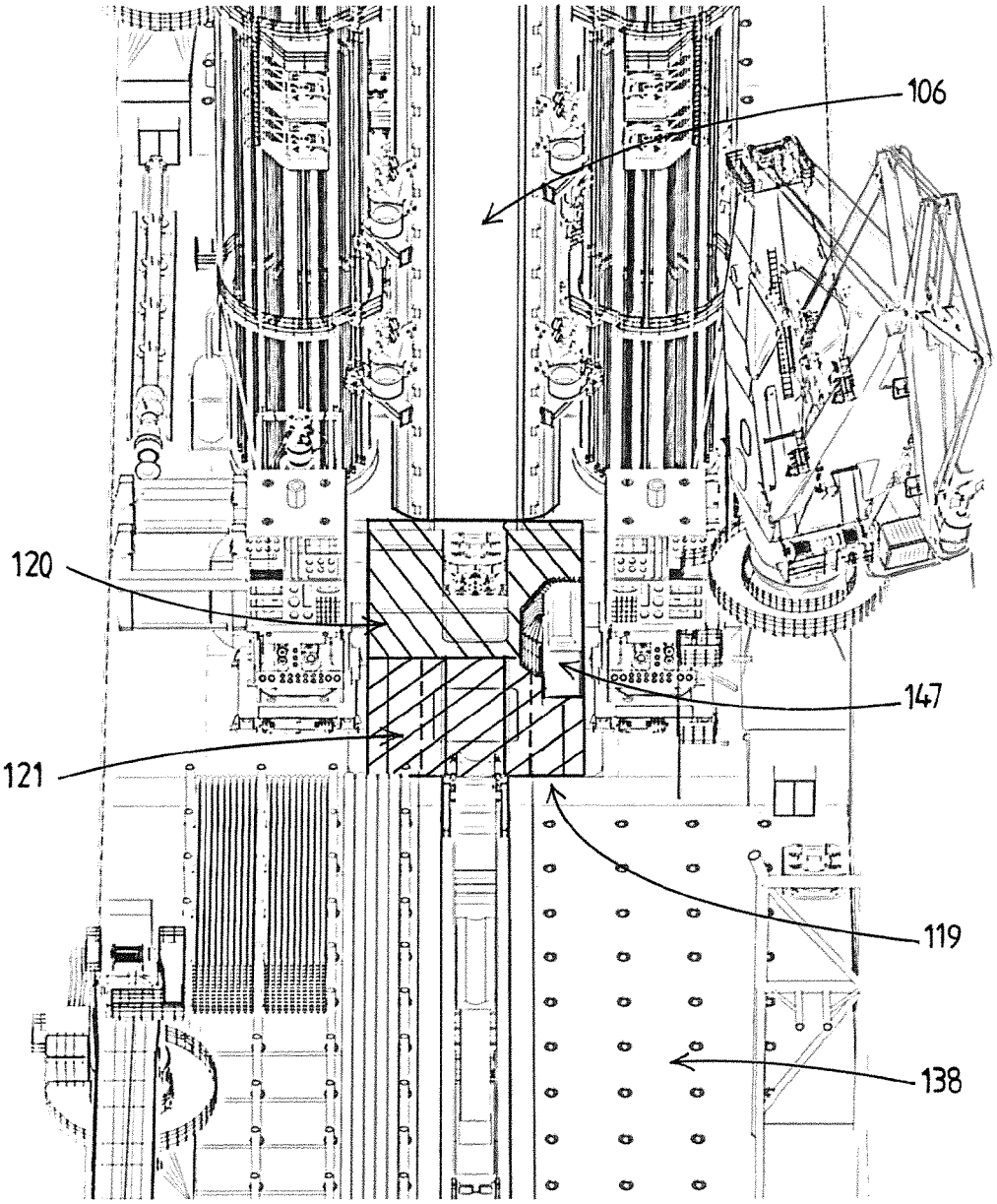
FIG. 22 shows a detailed perspective view of the second exemplary embodiment of FIG. 19, the vessel having the mobile working deck in the working position.
Figure 23:
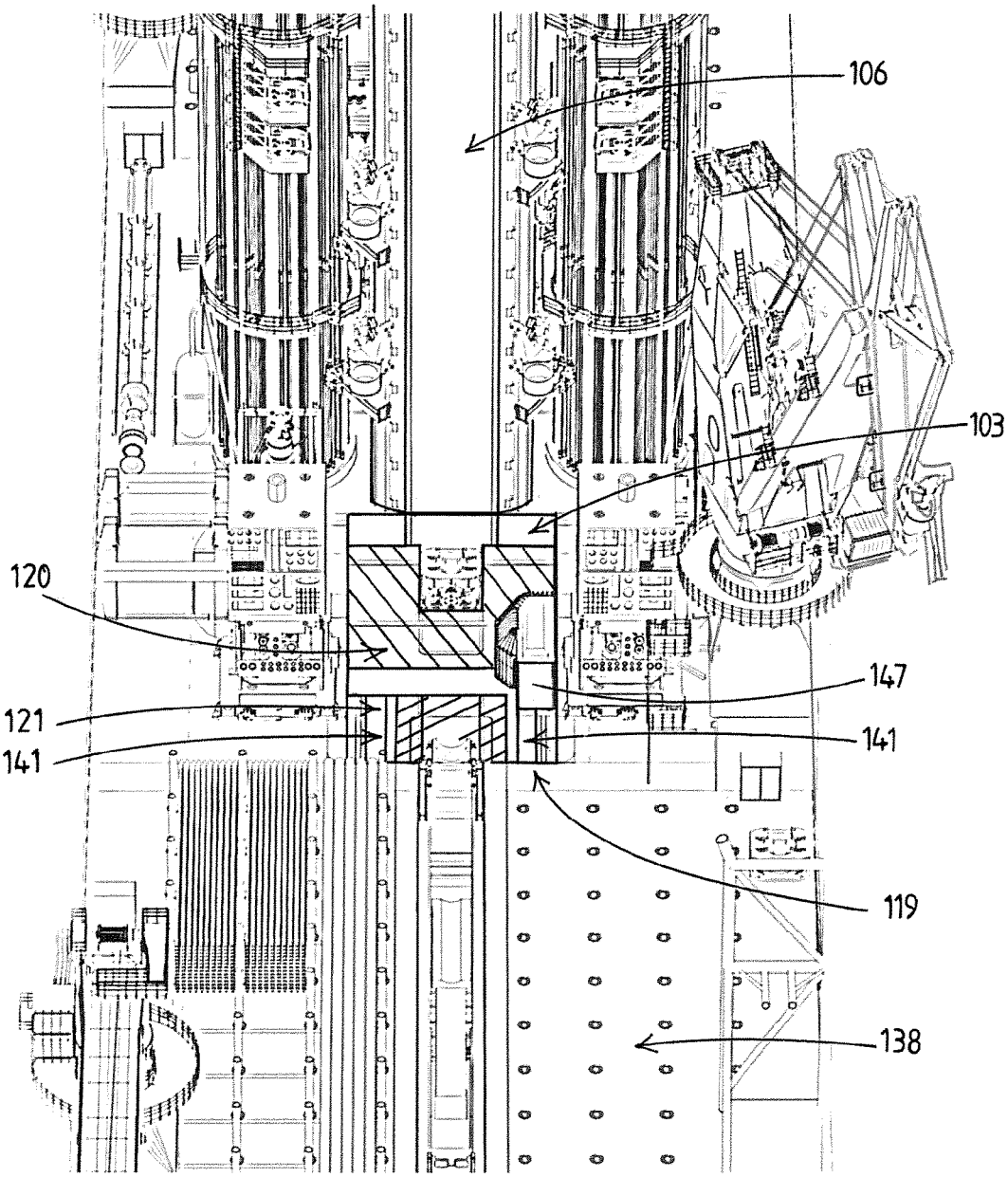
FIG. 23 shows a detailed perspective view of the second exemplary embodiment of FIG. 19, while the working deck is being converted into a transporting position.
Figure 24:
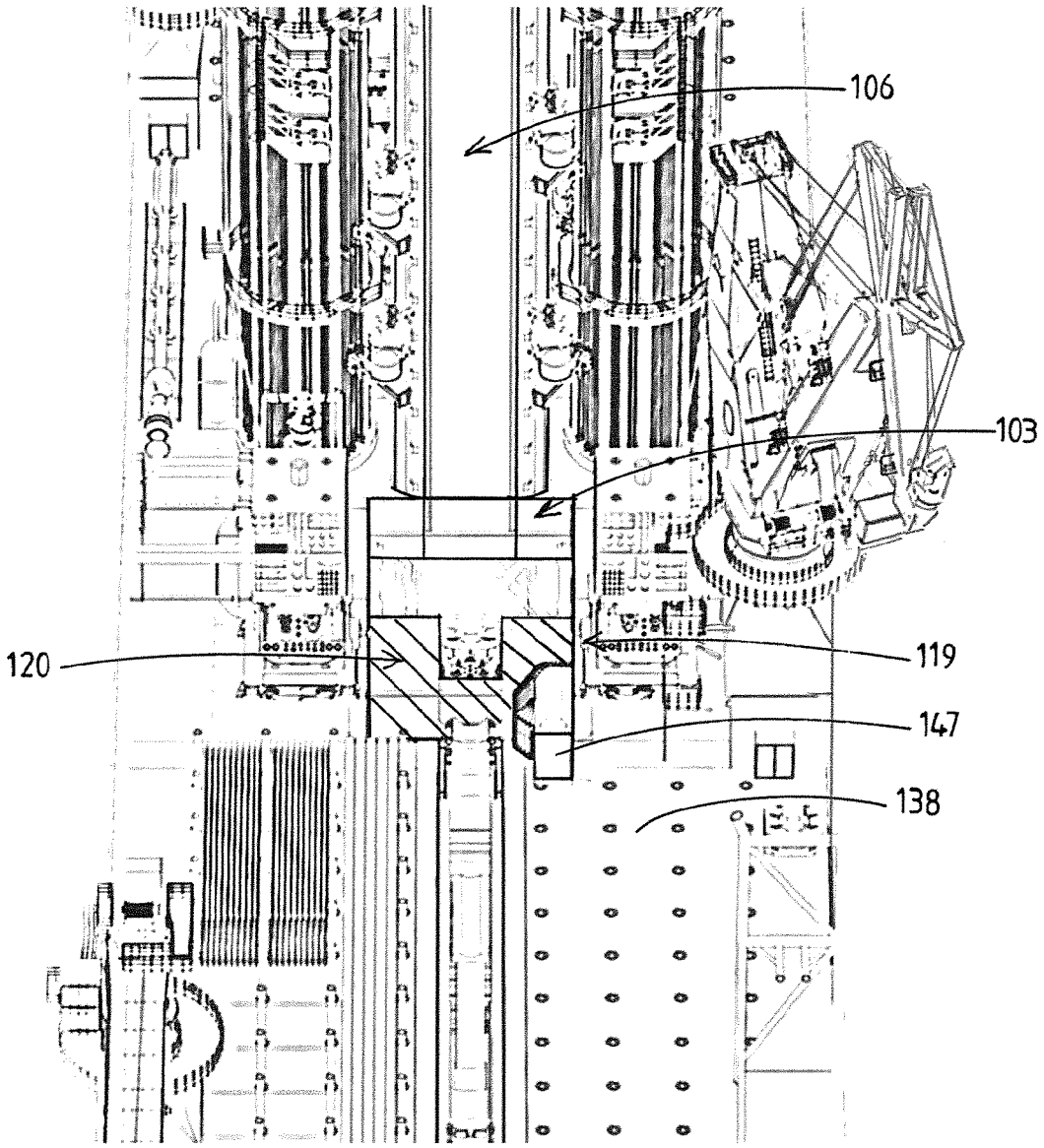
FIG. 24 shows a detailed perspective view of the second exemplary embodiment of FIG. 19, the working deck being in a transporting position.

FIGS. 19-21 show a schematic side view and top view of a section of a second exemplary embodiment of a vessel 101 according to the first aspect of the invention. FIGS. 22-24 FIG. 22 shows a detailed perspective view of this second exemplary embodiment.

The configuration of the working deck is identical to the configuration of the working deck of the first embodiment. The second embodiment differs from the first in the lay out of the vessel, and is in this aspect akin to the embodiment according to the second aspect of the invention shown in FIGS. 7-9.

In contrast with the vessel of the embodiment shown in FIGS. 16-18, the vessel of the second exemplary embodiment comprises a BOP transport system 123.

The BOP transport system 123 is configured for transporting a BOP 124 between a storage position at the BOP storage area 117 and a launch position above the moonpool 103, in which launch position the BOP 124 is located in the firing line 115 and can be manipulated by the hoisting device 111. In the preferred embodiment shown, the BOP storage areas are provided on opposite sides of the mobile working deck 119, which is clear from the top view depicted in FIG. 20

The BOP transport system 123 comprises a BOP track 126. The BOP track 126 is positioned above the moonpool 103 and comprises two parallel rails, which rails are supported by the hull 102 of the vessel such that they bridge the moonpool 103 with the firing line 1115 passing between the two rails.

The BOP transport system 123 comprises a BOP cart 125 for each BOP storage area 117. The rails of the BOP 126 track support the BOP carts such that the BOP carts can be moved between a storage position for supporting a BOP in its storage position and a firing line position for supporting a BOP in its launch position.

In the embodiment shown, the working deck 119 is located at the first side of the tower 106. The working deck 119 has a front section 120 facing the tower 106 and a rear section 121 facing away from the tower 106. The front section 120 of the working deck 119 is provided with a deck opening 122 for passing a tubular supported in the firing line 115 through the working deck 119.

The working deck 119 is configured to be moved between a working position and a BOP transporting position. The working deck 119 is a mobile working deck according to the first aspect of the invention. Therefore, the front section 120 and the rear section 121 of the working deck 119 are separate deck sections, and the off shore drilling vessel further comprises a working deck rear section lift system 150 for lifting and lowering the rear deck section, independent of the front deck section, between the working position and transporting position, and a working deck front section guide system 151 for guiding the front deck, independent of the rear deck section, in a substantially horizontal direction between the working position and transporting position.

When the working deck 119 is in the working position, the front deck section 120 and the rear deck section 121 are located adjacent each other, with the working deck front section 120 located adjacent the tower 106 such that the firing line 115 extends through the deck opening 122 of the working deck 119. In the particular embodiment shown, the working deck front section 120 furthermore covers part of the BOP transport track 126 such that the working deck 119 blocks movement of BOPs along the BOP track, when in the working position.

When the working deck 119 is in the transporting position, the front deck section 120 is located above the rear deck section 121, such that the working deck 119 clears the BOP transport track 126 and provides room for a BOP to be transported by the BOP transport system 123 from the BOP storage position into the BOP launch position above the moonpool 103.

In the embodiment shown, the drilling vessel with the improved mobile working deck 119 according to the invention allows for BOP storage areas 117 on opposite sides of the firing line 115. Furthermore, it is noted that a working deck according to the invention allows for multiple recessed storage areas on opposite sides of the mobile working deck, the benefits of which were already explained with respect to the working decks according to the second aspect of the invention.

According to the first aspect of the invention, the working deck 119 is a mobile working deck, which working deck is partially slid in a direction away from the tower 106 and which is partially lowered when being converted from its working position into its BOP transporting position. When the working deck 119 is in the transporting position, this allows for transporting BOP's along the BOP transport track. Therefore, in the context of this embodiment, the transporting position is also referred to as the BOP transporting position.

In the particular embodiment shown, the working deck front section 120 is configured to move subsea trees 130 into and out of the firing line 115. This in contrast with the embodiment shown in FIGS. 7-9, in which the mobile working deck is fully removed and a separate subsea tree transport system is provided. In the embodiment shown in FIGS. 19-21 the subsea trees 130 can be skidded onto and of the working deck front section 120 when the latter is in the transporting position, i.e. located above the lowered working deck rear section. In this particular embodiment of a vessel and working deck according to the invention, the working deck front section 120, when in the transporting position shown in FIG. 21, allows for transporting a BOP along the BOP track 126 and the working deck front section is able to receive subsea trees 130. Thus, in this embodiment, the transporting position can be referred to as the BOP transporting position as well as the subsea tree transporting position.

The invention thus allows for a compact configuration of the working deck 119 and for storage positions provided on opposite sides of the working deck, and thus for storing multiple BOPs and subsea trees such that they can be moved between their storage position and their launch position in the firing line efficiently, i.e. with a minimum of preparation time and/or with a minimum of transfers between transporting devices and/or over a minimum distance, without the working deck or sections thereof blocking the tower and/or the hoisting system.

It will be appreciated that the mobile working deck in such an embodiment is configured to, when in its working position, support the weight of the suspended string of tubulars in combination with a BOP and/or subsea tree. In a practical embodiment said weight will be at least 200 tonnes. Therefore, a working deck according to the invention has a structure able to support a string of tubulars, e.g. risers, possibly with a BOP and/or subsea tree attached to the lower end of the string, having a weight of at least 200 tonnes.

It is noted that, in such an embodiment, some of the advantages of the mobile working deck according to the invention are available even when there is no stationary main, or no stationary main deck which has a deck surface that is level with the deck surface of the working deck front section and/or the working deck rear section.

However, preferably, a stationary main deck is provided for storing equipment and/or tubulars, which main deck is adjacent to and flush with the working deck rear section when the working deck is in the working position, such that objects can be moved in a horizontal direction from the main deck onto the working deck, and the working deck front section is adjacent to and flush with the main deck when the working deck is in the transporting position, such that objects can be moved in a horizontal direction from the main deck onto the working deck front section. In yet a further embodiment, the main deck extends along the tower towards the front of the vessel and at the second side of the tower.

In the embodiment shown, the vessel 101 furthermore has a stationary main deck 138 onto which the subsea trees 130 are stored. The subsea tree storage positions are provided on opposite sides of the working deck and adjacent the BOP storage positions, and the working deck front section is provided with skid rails/guides for skidding a subsea tree in a horizontal direction from the subsea tree storage position onto the front deck section, when the front deck section is in the BOP transporting position.

In an alternative embodiment, the subsea trees may be stored in a recessed storage are, similar to the one shown in FIGS. 7-9. In such an embodiment, the main deck may be adjacent to the working deck at a rear edge thereof, and the working deck front section is only adjacent the stationary main deck when in the transporting position.

In the embodiment shown in FIGS. 16-18 the front deck guide system 151 comprises two support rails 141 for supporting the working deck front section when the working deck front section is in the transporting position and while the working deck front section is being moved between the working position and the transporting position. These support rails are located in the main deck structure on opposite sides of the working deck 119, and extend along the longitudinal sides of the working deck 119. The working deck front section is provided with lateral extensions which engage the support rails, such that the working deck front section is supported by the support rails when in the working position, in the transporting position, and while being moved between the working position and the transporting position.

In the embodiment shown, a coupling device is provided (not shown in the figures) that couples the rear deck section 121 with the support rails 141 when the rear deck section 121 is in the working position, such that the weight of the rear deck section, and any equipment located on the rear deck section, is supported by the two guide rails 141 and not by the rear deck lift system 150. In the embodiment shown, the coupling device is provided in the working deck rear section and is provided with extendable supports, which when the working deck rear section has been lifted in the working position are extended to engage the support rails. It is submitted that many types of coupling devices are conceivable within the scope of the invention.

In the embodiment shown in FIGS. 19-21 the front deck guide system 151 comprises two support rails 141' for supporting the working deck front section 120 when the working deck front section is in the transporting position and while the working deck front section is being moved between the working position and the transporting position. In contrast with the support rails 141 shown in FIGS. 16-18, the support rails only extend along the working deck rear section 121.

When in the working position, the working deck rear section 121 is located above the two support rails 141', and the working deck front section covers the support rails. Thus, the support rails are not visible in the top view shown in FIG. 19.

In the particular embodiment shown, the working deck rear section 121 comprises a central deck section 152 flanked by two movable side sections, in the particular embodiment shown hingeable deck sections 153. When the working deck rear section 121 is lowered into the transporting position, the movable side sections 153 are pivoted, from the extended position in which the cover the support rails 141' into a withdrawn position, in which they are located on top of the central deck section and between the support rails 141'. Thus, the support rails are free to support the working deck front section 120.

In the embodiment shown in FIGS. 19-21, the BOP transport track 126 comprises rails in the form of beams that cross the moon pool 103, and that are supported by the hull 102 on opposite sides of the moon pool. The rails of the BOP track 126 are provided with a guide surface for supporting and guiding the BOP cart 125. In the embodiment shown, the working deck front section 210 crosses the BOP transport track 126 when in the working position.

Furthermore, in this particular embodiment, the working deck front section 120 is supported the rails, i.e. the working deck front section is in direct contact with the guide surface of the rails, when in the working position.

In addition, in the embodiment shown, the BOP carts 125 are respectively provided with a dedicated working deck front section support surfaces 154 for supporting the working deck front section 120 when in the working position and for supporting the working deck front section 120 while being moved between the working position and the transporting position.

In the embodiment shown in FIGS. 19-21, the main deck is provided with transport rails 155 for supporting carts to transport objects, in the particular embodiment shown subsea trees 130, over the main deck 138, and the working deck front section 120 is provided with transport rails 155, which, when the working deck is in the transporting position, are in line with transport rails provided on the main deck such that a cart can be driven over the transport rails from the main deck onto the working deck and vice versa.

Preferably, the working deck front section 120 comprises a support frame with at least two load bearing support beams, preferably similar to the support frame and the support beams 141 shown in FIG. 3, which support beams extend on opposite sides of the deck opening 122. In a further preferred embodiment, the working deck front section comprises a suspension device, for example similar to the C-shaped and O-shaped clamping devices 49,50 disclosed with respect to the second aspect of the invention. The suspension device, is preferably attached to and supported by the support beams, such that a load supported by the suspension device is transferred directly from the suspension device to the support beams.

In the embodiment shown in FIGS. 19-21, the guide rails 141 have an upward facing guide surface for cooperating with a downward facing guide surface provided on support beams of the frame of the working deck front deck section 120.

In the embodiments shown, the working deck front section 120 is U shaped, comprising two legs extending on opposite sides of the deck opening 122, which deck opening is part of a slot shaped opening, the slot shaped opening extending up to a frontal edge of the working deck front section, such that a tubular supported in the firing line can be moved in a lateral direction via said slot into the deck opening by moving the front deck section from the transporting position into the working position. It is submitted that other shapes and or outlines are also possible, and that temporary inserts and/or covers may be provided for temporarily, for example while the working deck front section is in the transporting position, partially or wholly covering the working deck opening.

The first and second aspect of the invention have been described in detail with particular reference to certain preferred embodiments thereof, but it will be understood that combinations, variations and modifications can be effected within the scope of the system, especially to those skilled in the art.

According to a second aspect, the invention furthermore provides an offshore drilling vessel, according to one or more of the subsequent clauses. The drilling vessel according to clause 1 comprising:

a hull having a moonpool, the moonpool having a longitudinal axis;

a firing line hoist system, the firing line hoist system being supported by the hull, the firing line hoist system comprising:

a tower, the tower being arranged at said moonpool, and which tower has a top and a base, a first side and a second side, and wherein the base of the tower is connected to the hull of the vessel such that the first side of the tower faces the moonpool, and a hoisting device, which hoisting device comprises a load attachment device displaceable supported by the tower, one or more cables and one or more associated winches to manipulate the position of the load attachment device relative to the tower in a vertical direction along a firing line, which firing line extends on the outside of tower at the first side thereof, and which firing line extends through the moonpool, wherein the hoisting device is adapted for raising and lowering a tubular string with a BOP and/or subsea tree to the seabed;

a storage deck, located at the first side of the tower, the storage deck flanking at least part of the moonpool on opposite sides thereof, and which storage deck is provided on each side of the moonpool with a BOP storage area and with a subsea tree storage area, a working deck, located at the first side of the tower and above the storage deck, which working deck extends in the longitudinal direction of the moonpool, and, when seen in top view, is located between the BOP storage areas and the subsea tree storage areas, such that the BOP storage areas and subsea tree storage areas are open at the top to respectively accommodate a BOP or subsea tree having a height larger than the height between the storage deck and the working deck, and which working deck has a front section facing the tower and a rear section facing away from the tower, wherein the front section of the working deck is provided with a deck opening for passing a tubular supported in the firing line through the working deck, a BOP transport system, configured for transporting a BOP between a storage position at the BOP storage area and a launch position above the moonpool, in which launch position the BOP is located in the firing line and can be manipulated by the hoisting device, which BOP transport system comprises:

a BOP cart for each BOP storage area; and a BOP track, which BOP track comprises two parallel rails, being a tower rail located adjacent the tower and a storage rail located between the BOP storage areas and the subsea tree storage areas, which rails are supported by the hull such that they bridge the moonpool in a direction perpendicular to the longitudinal axis of the moonpool, and which rails support the BOP carts such that they can be moved between a storage position for supporting a BOP in its storage position and a firing line position for supporting a BOP in its launch position;

a subsea tree transport system, configured for transporting a subsea tree between a storage position at the subsea tree storage area and a launch position above the moonpool, in which launch position the subsea tree is located in the firing line and can be manipulated by the hoisting device, which subsea tree transport system comprises:

a moonpool cart;

a moonpool track, which moonpool track comprises two parallel rails that extend on opposite sides of the moonpool parallel to the longitudinal axis thereof, which rails support the moonpool cart such that it can be moved in said longitudinal direction between a receiving position located between the subsea tree storage areas and a firing line position for supporting a subsea tree in its launch position, and;

a subsea tree loading device, configured for moving a subsea tree from its storage position onto the moonpool cart and from the moonpool cart into its storage position;

wherein the BOP track is positioned above the moonpool track and crosses the moonpool track such that the firing line passes between the two rails of the BOP track and between the two rails of the moonpool track, and wherein the storage rail of the BOP track comprises a removable rail section, which removable rail section crosses the moonpool track and can be removed to enable a subsea tree to be moved by the subsea tree transport system along the moonpool track, wherein the working deck is a mobile working deck, configured to be moved between a working position, a BOP transporting position, and a subsea tree transporting position, in which working position the working deck is located with its front section adjacent the tower such that the firing line extends through the deck opening, and in which position the working deck blocks movement of BOPs along the BOP track and blocks movement of the subsea trees along the moonpool track, in which BOP transporting position the working deck clears the BOP track, such that it provides room for a BOP to be transported by the BOP transport system into its launch position above the moonpool, and in which position the working deck blocks movement of a subsea tree along the moonpool track, in which subsea tree transporting position the working deck clears the BOP track and the moonpool track such that it provides room for a subsea tree to be moved by the subsea tree transport system into its launch position above the moonpool.

2. Offshore drilling vessel according to clause 1, wherein the vessel furthermore has a main deck for storing equipment and/or tubulars, which main deck is provided at the aft of the vessel, and which main deck is adjacent to and flush with the working deck when the latter is in its working position, such that objects can be moved in a horizontal direction from the main deck onto the working deck.

3. Offshore drilling vessel according to clause 2, wherein the main deck is provided with transport rails for supporting carts to transport objects over the main deck, and wherein the working deck is provided with transport rails, which, when the working deck is in its working position, are in line with transport rails provided on the main deck such that a cart can be driven over the transport rails from the main deck onto the working deck and vice versa.

4. Offshore drilling vessel according to 2 or 3, wherein the main deck extends along the tower towards the front of the vessel and at the second side of the tower.

5. Offshore drilling vessel according to one or more of the preceding clauses, wherein the front section of the working deck is a heavy duty section, configured for supporting a riser string in the firing line preferably with a BOP and/or a subsea tree attached to the lower end of the riser string, which heavy duty section of the working deck is supported by the rails of the BOP track when the working deck is in its working position.

6. Offshore drilling vessel according to clause 5, wherein the front section of the working deck is provided with support beams on opposite sides of the deck opening, the support beams extending in the longitudinal direction of the moonpool when the working deck is in its working position, and which support beams preferably are directly supported by the rails of the BOP track when the working deck is in its working position.

7. Offshore drilling vessel according to clause 6, wherein the working deck comprises a suspension device for supporting a riser string, which suspension device supported by the support beams, such that a load supported by the suspension device is transferred directly from the suspension device to the support beams.

8. Offshore drilling vessel according to one or more of the preceding clauses, wherein the rails of the BOP track are heavy duty rails, configured for together supporting two BOP's of each at least 200 tonnes, and preferably for at the same time supporting the heavy duty section supporting a riser, of the working deck.

9. Offshore drilling vessel according to one or more of the preceding clauses, wherein the two rails sections of the storage rail of the BOP track, which are located between the BOP storage areas and the subsea tree storage areas on opposite sides of the moonpool, are supported such that they can each carry at last half the weight of a BOP when the removable rail section has been removed.

10. Offshore drilling vessel according to one or more of the preceding clauses, wherein the removable rail section of the storage rail of the BOP track is pivotable connected with one of the two rails sections that are provided between the BOP storage areas and the subsea tree storage areas on opposite sides of the moonpool, to enable the rail section to be pivoted out of its position and into its position between the two rails sections that are provided between the BOP storage areas and the subsea tree storage areas on opposite sides of the moonpool.

11. Offshore drilling vessel according to one or more of the preceding clauses, wherein the working deck is configured to, as a whole, be lifted out of and lowered into its working position, to convert the working deck into its BOP transporting position and/or its subsea tree transporting position, for example by a crane such as an overhead crane.

12. Offshore drilling vessel according to one or more of the clauses 1-10, wherein the working deck is a sliding working deck, configured for being slid as a whole into the longitudinal direction of the moonpool to convert the working deck into its BOP transporting position and its subsea transporting position.

13. Offshore drilling vessel according to one or more of the preceding clauses, wherein the front section and the rear section of the working deck are separate deck sections which preferably are movable, for example hingeable connected to each other, such that they can be moved relative to each other, for example be pivoted relative to each other.

14. Offshore drilling vessel according to clause 13, wherein the two deck sections are hingeable connected such that the front section of the working deck can be pivoted upward over an angle of about 90 degrees relative to the rear deck section, between a horizontal position and an inactive upright position, and wherein the working deck can be converted into its BOP transporting position by pivoting the front section of the deck in the upright position, in which the front section of the working deck clears the BOP track such that a BOP can be transported by the BOP transport system into its launch position above the moonpool.

15. Offshore drilling vessel according to clause 13, wherein the two deck sections are hingeable connected such that the front section of the working deck can be pivoted upward over an angle of about 180 degrees relative to the rear deck section, between a horizontal position and an inactive horizontal position in which its folded adjacent the top surface of the rear section of the working deck, and wherein the working deck can be converted into its BOP transporting position by pivoting the front section of the deck in a folded position adjacent the top surface of the rear section of the working deck, in which folded position the front section of the working deck clears the BOP track such that a BOP can be transported by the BOP transport system into its launch position above the moonpool.

16. Offshore drilling vessel according to clause 14 or 15, wherein the vessel furthermore has a main deck for storing equipment and/or tubulars, which main deck is provided at the aft of the vessel, and which main deck preferably is adjacent to and flush with the working deck when the latter is in its working position, and wherein the rear section of the working deck is configured for being slid onto the main deck, while the front section of the working deck has been pivoted into its inactive position, to convert the working deck into its subsea tree transporting position.

17. Offshore drilling vessel according to one or more of the clauses 14-16, wherein the rear section of the working deck is hingeable connected to a rear support of the working deck, such that the rear section of the working deck can be pivoted upward, over an angle of at least 90 degrees, while the front section of the working deck has been pivoted upward into its inactive position, to convert the working deck into its subsea tree transporting position.

18. Offshore drilling vessel according to clause 13, wherein the two deck sections are hingeable connected such that the front section of the working deck can be pivoted downward relative to the rear section of the deck, over an angle of about 180 degrees, into an inactive position in which its folded adjacent the bottom surface of the rear section of the working deck, and wherein the rear section of the working deck is hingeable connected to a rear support of the working deck, such that the rear section of the working deck can be pivoted upward, over an angle of at least 90 degrees, while the front section of the working deck is being pivoted into its inactive position adjacent the bottom surface of the rear deck section, to convert the working deck into its BOP transporting position and its subsea tree transporting position.

19. Offshore drilling vessel according to one or more of the clauses 14-18, wherein the rear section of the working deck, and optionally the front section of the working deck which is hingeable connected to the rear section, is/are provided with engagement devices, such as hooks or loops, for engagement by a lifting device, preferably a crane, for example an overhead crane, to enable the lifting device to engage the rear section, and optionally the rear section and the front section, of the working deck, to lift, move and lower the working deck into its subsea tree transporting position.

20. Offshore drilling vessel according to one or more of the preceding clauses, wherein the vessel is provided with mobile working deck support rails for supporting the working deck while it is slid in the longitudinal direction of the moonpool, which working deck support rails during use extend in the longitudinal direction of the moonpool and bridge the gap between the tower rail and the storage rail of the BOP track and/or bridge the gap between the storage rail of the BOP track and a main deck provided on the opposite side of the subsea tree storage areas.

21. Offshore drilling vessel according to clause 20, wherein the mobile working deck support rails are pivotable supported, such that they can be removed by pivoting them in an upright position to allow the BOPs to be moved into the firing line and/or the subsea trees to be moved onto the moonpool cart when the working deck has been converted into its BOP transporting position and its subsea tree position respectively.

22. Offshore drilling vessel according to one or more of the preceding clauses, wherein the front section or the rear section of the working deck is a slideable deck section, or the front section and the rear section are slideable deck sections.

23. Offshore drilling vessel according to clause 22, wherein the vessel is provided with mobile working deck support rails for supporting the front section and/or the rear section of the working deck while it is/they are slid in the longitudinal direction of the moonpool to convert the working deck from its working position into its BOP transporting position and/or its subsea tree transporting position, which working deck support rails during use extend in the longitudinal direction of the moonpool and bridge the gap between the tower rail and the storage rail of the BOP track and/or bridge the gap between the storage rail of the BOP track and a main deck provided on the opposite side of the subsea tree storage areas.

24. Offshore drilling vessel according to clause 23, wherein the mobile deck support rails are pivotable supported, such that they can be removed by pivoting them in an upright position to allow the BOPs to be moved into the firing line and/or the subsea trees to be moved onto the moonpool cart when the working deck has been converted into its BOP transporting position and its subsea tree position respectively.

25. Offshore drilling vessel according to one or more of the clauses 22-24, wherein the front section of the working deck is configured to be slid onto the rear section of the working deck to convert the working deck into its BOP transporting position, and preferably wherein the rear section of the working deck is configured to be slid, optionally while supporting the front section of the working deck, onto a main deck adjacent the subsea tree storage position, which main deck preferably is flush with the working deck when the latter is its working position.

26. Offshore drilling vessel according to one or more of the clauses 22-24, wherein the two slideable deck section are connected, such that when the front section is slid onto a main deck adjacent the subsea tree storage position, which main deck preferably is flush with the working deck when the latter is its working position, the front section of the working deck is slid into the previous position of the rear working deck section, and the working deck is thus converted into its BOP transporting position.

27. Offshore drilling vessel according to one or more of the clauses 26, wherein, when the rear section of the working deck is slid further onto the main deck, the front section of the working deck is also slid onto the main deck and the working deck is converted into its subsea tree transporting position.

28. Offshore drilling vessel according to one or more of the preceding clauses, wherein a control room is located on the working deck, preferably on the rear section of the working deck.

29. Offshore drilling vessel according to clause 28, wherein the control room is moveably supported on the working deck, for example is supported on rails extending in the longitudinal direction of the moon pool, such that the control room can be moved between a position on the front section of the working deck and a position on the rear section of the working deck, for example to be moved onto the rear section of the working deck when the front section of the working deck is pivoted into an upright position to convert the working deck into its BOP transporting position.

30. Offshore drilling vessel according to clause 28, wherein the control room is provided on the rear section of the working deck, and is supported at such a height above the working deck, that the front section of the working deck can be slid onto the rear section of the working deck, below the control room supported on that rear section of the working deck.

31. Offshore drilling vessel according to clause 28, wherein the control room is supported by a hingeable mast or segmented arm, for example similar to the arm of a knuckle boom crane, which mast or arm is mounted on the hull of the vessel such that the control room can be supported above the working deck and can keep that position and/or allows for adjusting that position while the working deck is converted into its BOP transporting position and/or its subsea tree transporting position.

32. Offshore drilling vessel according to one or more of the preceding clauses, wherein the deck opening is part of a slot shaped opening, the slot shaped opening comprising two slideable support devices, which slideable support devices can be moved into and out of the firing line when the deck is in its working position, and which support devices thus define the deck opening when in the firing line.

33. Offshore drilling vessel according to one or more of the preceding clauses, wherein the deck opening is part of a slot shaped opening, the slot shaped opening extending up to a frontal edge of the working deck, the working deck thus comprising two leg parts on opposite side of the slot shaped opening and thus providing the front section of the working deck with a U-shape, such that a tubular can be moved in a lateral direction via said slot into the deck opening.

34. Offshore drilling vessel according to clause 33, wherein at least the frontal section of the working deck is hingeable supported such that it can be pivoted about a pivot axis perpendicular to the longitudinal axis of the moonpool, and wherein the slot shaped opening allows for pivoting at least the working section from a non-active upright position into an active horizontal position while a tubular is supported in the firing line, to thus receive said tubular in the deck opening via the elongate slot between the two leg parts.

35. Offshore drilling vessel according to clause 34, wherein the U-shaped front section of the working deck is pivotally supported such that it can be pivoted about a working deck pivot axis, which working deck pivot axis extends parallel to the rails of the BOP track and is provided at a distance from the tower such that, when the working deck is in its working position, the BOP track extends between the pivot axis and the tower, and wherein a working deck pivot drive is provided that can pivot the working deck about said pivot axis between:

an active position, in which the U-shaped working deck front section rests on the rails of the BOP track, and extends in a substantially horizontal direction such that it covers a portion of the moonpool while the firing line extends through the elongate slot at the closed end thereof, and a non-active position, in which the U-shaped working deck front section clears the BOP track and extends in a substantially vertical direction such that it provides room for a BOP to be moved by the BOP transport system into its launch position above the moonpool between the tower and the working deck, and wherein the working deck is pivotally supported, such that when the U-shaped working deck section is pivoted from its non-active position into its active position while a tubular is supported in the firing line, the tubular is received in the elongate slot between the two leg parts.

36. Offshore drilling vessel according to one or more of the clauses 33-35, wherein the U-shaped working deck section comprises at least two support beams, which support beams extend parallel to the legs of the U-shaped working deck on opposite sides of the elongate slot, and wherein the support beams rest directly on one of, preferably on both of, the rails of the BOP track, when the U-shaped working deck section is in its working position.

37. Offshore drilling vessel according to one or more of the clauses 33-36, wherein the U-shaped working deck section comprises movable deck parts, for example in the form of a removable hatch or a sliding deck part, for, when the deck section is in its active position, covering part of the elongate slot while keeping the elongate slot near its closed end uncovered to enable a tubular supported in the firing line to pass through the elongate slot at the closed end thereof.

38. Offshore drilling vessel according to one or more of the preceding clauses, wherein the removable rail section is configured to be lifted out of and lowered into place, for example by a crane such as an overhead crane, between the two rails sections that are provided between the BOP storage areas and the subsea tree storage areas on opposite sides of the moonpool.

39. Offshore drilling vessel according to one or more of the clauses 1-37, wherein the removable rail section is connected to the working deck, or to a section of the working deck, and the working deck and rail section are configured such that the rail section is removed with the working deck when the latter is moved from its BOP transporting position to its subsea tree transporting position.

40. Offshore drilling vessel according to one or more of the clauses 1-37, wherein the removable rail section is pivotable connected with one of the two rails sections that are provided between the BOP storage areas and the subsea tree storage areas on opposite sides of the moonpool, to enable the rail section to be pivoted out of and into place between the two rails sections that are provided between the BOP storage areas and the subsea tree storage areas on opposite sides of the moonpool.

41. Offshore drilling vessel according to one or more of the clauses 1-37, wherein the removable rail section is configured to be slid out of and slid into place, preferably along one of the rail sections located between a BOP storage area and a subsea tree storage area.

42. Offshore drilling vessel according to one or more of the preceding clauses, wherein the subsea tree loading device comprises:

a subsea tree cart for each subsea tree storage position, a subsea tree track at each subsea tree storage position, which subsea tree tracks each comprise two parallel rails for supporting an subsea tree cart, which rails extend in a direction perpendicular to the longitudinal axis of the moonpool to enable, when the moonpool cart is located in its receiving position, the subsea tree carts to be moved between a storage position for supporting an subsea tree in its storage position and a transport position located on the moonpool cart.

43. Offshore drilling vessel according to one or more of the clauses 1-41, wherein the subsea tree loading device is configured for use with subsea trees comprising a cart, which cart is a component of the subsea tree, and wherein the subsea tree loading device comprises:

a subsea tree track at each subsea tree storage position, which subsea tree tracks each comprise two parallel rails for supporting a tree cart of a subsea tree, which rails extend in a direction perpendicular to the longitudinal axis of the moonpool to enable, when the moonpool cart is located in its receiving position, the subsea trees to be moved between their storage position and a transport position in which they are located on the moonpool cart.

44. Offshore drilling vessel according to one or more of the clauses 1-41, wherein the subsea tree loading device comprises:

an overhead crane, which overhead crane, when positioned over the subsea tree storage positions, can lift a subsea tree and move that tree between its storage position and the moonpool cart.

45. Offshore drilling vessel according to one or more of the preceding clauses, wherein the moonpool track supports additional carts for moving equipment, riser strings, or tubes along the moonpool, and optionally, wherein the moon pool cart is configured for transporting equipment, riser strings, or tubes along the moonpool.

46. Offshore drilling vessel according to one or more of the preceding clauses, wherein the working deck and/or the vessel are provided with locking devices for securing the working deck, preferably for securing both the front and the rear section of the working deck, in the working position 47. Offshore drilling vessel according to one or more of the preceding clauses, wherein actuators, such as one or more hydraulic cylinders and/or one or more drives, are provided for pivoting the deck sections of the working deck relative to each other and/or relative to the vessel.

48. Offshore drilling vessel according to one or more of the preceding clauses, wherein actuators, such as one or more hydraulic cylinders, one or more drives, one or more winches, are provided for sliding the deck sections of the working deck relative to each other and/or relative to the vessel.

49. Offshore drilling vessel according to one or more of the preceding clauses, wherein the front section and/or the rear section of the working deck comprise multiple sections which sections are hingeable connected such that the sections can be pivoted relative to each other, for example be folded upon each other, to adjust the shape and/or size of the deck sections, for example to enable the front deck section to be folded onto the rear deck section adjacent a control room provided on that rear deck section.

50. Offshore drilling vessel according to one or more of the preceding clauses, wherein the front section and/or the rear section of the working deck comprise sections which can be removed independently from the deck sections themselves, for example comprise deck sections which are pivotable connected to the tower or the hull of the vessel and which can be pivoted in for example an upright non active position while the deck section it belongs to is to be slid in the longitudinal direction of the moonpool to convert the working deck into its BOP transporting position or its subsea tree transporting position.

51. Offshore drilling vessel according to one or more of the preceding clauses, wherein the BOP carts have a support frame that is provided with a lateral opening that allows for a tubular, for example a riser held by the hoisting device and supporting a BOP, to be moved, in a lateral direction, into or out of the BOP support frame.

52. Offshore drilling vessel according to one or more of the preceding clauses, wherein the rails of the BOP track are provided in the form of beams that cross the moonpool, and that are supported by the hull on opposite sides of the moonpool, and wherein at least one of the guiderails of the BOP track is provided with a guide surface for supporting and guiding the at least one BOP cart and with a separate support surface for supporting the working deck.

53. Offshore drilling vessel according to one or more of the preceding clauses, wherein the base of the tower is connected to the hull of the drilling vessel at the moonpool at opposite sides thereof, such that at least the first side of the tower and preferably also the second side of the tower bridges the moonpool in a lateral direction thereof.

54. Offshore drilling vessel according to one or more of the preceding clauses, wherein the off shore drilling vessel is a monohull drilling vessel, the monohull having an elongate shape extending along a longitudinal axis, and wherein the longitudinal axis of the moonpool is parallel to the longitudinal axis of the monohull drilling vessel.

55. Offshore drilling vessel according to one or more of the preceding clauses, wherein the drilling vessel further comprises:

a riser tensioner system adapted to be connected to a top end of a riser string, in order to suspend the riser string from in the second firing line; and/or a suspended riser transfer device, comprising:

a riser hang-off assembly a gimbal device; and a frame supporting both the riser hang-off assembly and the gimbal device, which frame is moveably supported for movement along the longitudinal axis of the moonpool, preferably is movably supported by the moonpool track.

56. Method for riser string handling, using an offshore drilling vessel according to one or more of the preceding clauses.

57. Method according to clause 56, further comprising the step of lowering a BOP or a subsea tree from the offshore drilling vessel, wherein the mobile working deck is moved in its BOP transporting direction or subsea tree transporting position respectively, and the BOP or subsea tree is brought into the first firing line thus cleared by the mobile working deck.

From the foregoing, it will be clear to the skilled person, that within the framework of the invention as set forth in the claims and clauses, also many variations other than and combinations of the examples described above are conceivable. For example, the mobile working deck according to the first aspect of the invention may be combined with the vessel lay out of a vessel according to the second aspect of the invention.

REFERENCE SIGNS

1. offshore drilling vessel—vessel
2. hull
3. Moonpool
4. longitudinal axis moonpool
5. firing line hoisting system
6. tower
7. top tower
8. Base tower
9. First side tower
10. Second side tower
11. Hoisting device
12. Load attachment device
13. Cables
14. Winches associated with cables
15. Firing line
16. Storage deck
17. BOP storage area
18. Subsea tree storage area
19. Working deck
20. Front section of the working deck
21. Rear section of the working deck
22. Deck opening
23. BOP transport system

24. BOP
25. BOP cart
26. BOP track
27. Tower Rails BOP track
28. Storage rail BOP track
29. subsea tree transport system
30. subsea tree
31. Moonpool cart
32. Moonpool track
33. Rails moonpool track
34. Subsea tree loading device
35. Line of movement BOP
36. Line of movement subsea tree
37. Removable section storage rail BOP track
38. Main deck
39. Transport rails on (working)deck
40. Riser string
41. Support beams front section working deck
42. Suspension device working deck
43. Screen of working deck
44. Lifting frame
45. Subsea tree cart
46. Subsea tree track
47. Control room
48. leg parts working deck
49. C-shaped clamping device
50. O-shaped clamping device
101 vessel
102 hull
103 Moonpool
104
105 firing line hoisting system
106 tower
107 top tower
108 Base tower
109 First side tower
110 Second side tower
111 Hoisting device
112
113
114
115 Firing line
116
117 BOP storage area
118 Subsea tree storage area
119 Working deck
120 Front section of the working deck
121 Rear section of the working deck
122 Deck opening
123 BOP transport system
124 BOP
125 BOP cart
126 BOP track
127
128
129
130 subsea tree
131
132
133
134
135
136
137
138 Main deck
139
140
141 Support beams front section working deck
142
143
144
145
146
147 Control room
148
149
150 Working deck rear section lift system
151 Working deck front section guide system
152 Central deck section working deck rear section
153 Movable side section working deck rear section
154 dedicated working deck front section support surfaces
155 subsea transport rails

The invention claimed is:

1. A vessel, the vessel comprising:
a hull having a moonpool;
a firing line hoist system, the firing line hoist system comprising:
a tower, which tower is arranged at said moonpool, and is connected to the hull of the vessel; and
a hoisting device, which hoisting device comprises a load attachment device, one or more cables and one or more associated winches to manipulate the position of the load attachment device relative to the tower in a vertical direction along a firing line, which firing line extends through the moonpool, wherein the hoisting device is adapted for raising and lowering equipment through the moonpool;
a stationary main deck for storing equipment and/or tubulars;
a mobile working deck, which working deck is configured to be moved between a working position and a transporting position, the mobile working deck comprising a front deck section having a deck opening for receiving the firing line, and a rear deck section located adjacent the stationary main deck;
a rear deck lift system for lifting and lowering the rear deck section, independent of the front deck section, between the working position and the transporting position; and
a front deck guide system for guiding the front deck section, independent of the rear deck section, in a substantially horizontal direction between the working position and the transporting position,
wherein, when the working deck is in the working position, the front deck section and the rear deck section are located adjacent each other, with the working deck front section located above the moonpool and adjacent the tower such that the firing line extends through the deck opening of the working deck, and
wherein, when the working deck is in the transporting position, the front deck section is located above the rear deck section and adjacent the stationary main deck.

2. The vessel according to claim 1, wherein the main deck is flush with the working deck rear section when the working deck is in the working position, such that objects can be moved in a horizontal direction from the main deck onto the working deck, and the working deck front section is flush with the main deck when the working deck is in the transport position, such that objects can be moved in a horizontal direction from the main deck onto the working deck front section.

3. The vessel according to claim 1, wherein the main deck is provided with transport rails for supporting carts to transport objects over the main deck, and wherein the working deck front section is provided with transport rails, which, when the working deck is in the transporting position, are in line with transport rails provided on the main deck such that a cart can be driven over the transport rails from the main deck onto the working deck and vice versa.

4. The vessel according to claim 1, wherein the front deck guide system comprises:

two support rails for supporting the working deck front section when the working deck front section is in the transporting position and while the working deck front section is being moved between the working position and the transporting position, and wherein the rear deck section is located above the two support rails when in the working position and is located between and/or below the two support rails when in the transporting position.

5. The vessel according to claim 4, wherein a coupling device is provided that can coupled the rear deck section with the support rails when the rear deck section is in the working position, such that the weight of the rear deck section, and any equipment located on the rear deck section, is supported by the two support rails and not by the rear deck lift system.

6. The vessel according to claim 4, wherein the rear deck section has a central deck section flanked by two movable side sections, which movable side sections can be moved between an extended position, in which they cover the support rails when the rear deck section is in the working position, and a withdrawn position, in which they are located between the support rails when the rear deck section is in transporting position.

7. The vessel according to claim 1, wherein the working deck front section comprises a support frame with at least two load bearing support beams, which support beams extend on opposite sides of the deck opening.

8. The vessel according to claim 7, wherein the working deck front section comprises a suspension device, which suspension device is attached to and supported by the support beams, such that a load supported by the suspension device is transferred directly from the suspension device to the support beams.

9. The vessel according to claim 7, wherein the support rails extend along the moonpool on opposite sides thereof.

10. The vessel according to claim 1, wherein the front deck guide system comprises two extendable support arms, which support arms, when extended, cross the moon pool to support the front deck section when moved between the working position and the transporting position.

11. The vessel according to claim 10, wherein the extendable support arms comprise hydraulic cylinders configured to push or pull the front working deck section into or out of the transporting position.

12. The vessel according to claim 10, wherein the extendable support arms have an upward facing guide surface for cooperating with a downward facing guide surface provided on the front deck section.

13. The vessel according to claim 12, wherein the guide surfaces have a slanted front and/or end section such the front deck section is slightly lifted when the guide surfaces of the guide arms meet the guide surfaces of the front deck section while the support arms are extended into their support position.

14. The vessel according to claim 1, wherein the working deck front section is U shaped, comprising two legs extending on opposite sides of the deck opening, which deck opening is part of a slot shaped opening, the slot shaped opening extending up to a frontal edge of the working deck front section, such that a tubular supported in the firing line can be moved in a lateral direction via said slot into the deck opening by moving the front deck section from the transporting position into the working position.

15. The vessel according to claim 1, wherein the working deck and/or the vessel are provided with locking devices for securing the working deck in the working position, such that the working deck is fixed relative to the hull of the vessel.

16. The vessel according to claim 1, wherein the working deck rear section lift system is a hydraulic lift, a jackscrew lift, a rack and pinion lift, or a scissors lift.

17. The vessel according to claim 1, wherein actuators are provided for sliding the deck sections of the working deck relative to each other and/or relative to the vessel.

18. The vessel according to claim 17, wherein the actuators are one or more hydraulic cylinders, one or more drives or one or more winches.

19. The vessel according to claim 1, wherein the vessel is an off shore monohull drilling vessel, the monohull having an elongate shape extending along a longitudinal axis, wherein the moonpool has an elongate shape extending along a longitudinal axis, the moonpool being parallel with the longitudinal axis of the monohull of drilling vessel.

20. A method for moving equipment into and/or out of the firing line using the vessel according to claim 1.

* * * * *